US010548350B2

(12) United States Patent
Greim et al.

(10) Patent No.: US 10,548,350 B2
(45) Date of Patent: Feb. 4, 2020

(54) AEROSOL-GENERATING DEVICE AND SYSTEM

(71) Applicant: Philip Morris Products S.A., Neuchatel (CH)

(72) Inventors: Olivier Greim, Yverdon-les-Bains (CH); Julien Plojoux, Geneva (CH); Dani Ruscio, Cressier (CH); Laurent Manca, Sullens (CH)

(73) Assignee: Philip Morris Products S.A., Neuchatel (CH)

( * ) Notice: Subject to any disclaimer, the term of this patent is extended or adjusted under 35 U.S.C. 154(b) by 1038 days.

(21) Appl. No.: 14/370,316

(22) PCT Filed: Dec. 28, 2012

(86) PCT No.: PCT/EP2012/077084
§ 371 (c)(1),
(2) Date: Jul. 2, 2014

(87) PCT Pub. No.: WO2013/102611
PCT Pub. Date: Jul. 11, 2013

(65) Prior Publication Data

US 2015/0020832 A1 Jan. 22, 2015

(30) Foreign Application Priority Data

Jan. 3, 2012 (EP) ..... 12150114
Feb. 13, 2012 (EP) ..... 12155241
(Continued)

(51) Int. Cl.
*A24F 47/00* (2006.01)

(52) U.S. Cl.
CPC ..... *A24F 47/008* (2013.01)

(58) Field of Classification Search
CPC ..... A24F 47/008
(Continued)

(56) References Cited

U.S. PATENT DOCUMENTS 1,674,617 A 6/1928 De Benedictis
3,200,819 A 8/1965 Gilbert
(Continued)

FOREIGN PATENT DOCUMENTS

CN 101277622 A 10/2008
CN 101657116 A 2/2010
(Continued)

OTHER PUBLICATIONS

Office Action dated Dec. 28, 2015 in the corresponding Chinese Patent Application No. 20128007046.8 (English Translation only).
(Continued)

*Primary Examiner* — Dana Ross
*Assistant Examiner* — Ket D Dang
(74) *Attorney, Agent, or Firm* — Oblon, McClelland, Maier & Neustadt, L.L.P.

(57) ABSTRACT

An electrical system is provided, including primary and secondary devices, the primary device including an electrical power source; a cavity to receive the secondary device; at least one electrical contact within the cavity to contact a corresponding contact on the secondary device when the secondary device is in the cavity, the electrical contact being electrically connected to the source; at least one data contact to transfer data between the primary and secondary devices; and a lid moveable between a first position to retain the secondary device in contact with the electrical and data contacts and a second position in which the secondary device is free to move out of contact with the electrical and data contacts, wherein in the first position the lid urges the secondary device into contact with the electrical and data
(Continued)

contacts, and wherein the secondary device is keyed to the cavity of the primary device.

15 Claims, 15 Drawing Sheets

(30) Foreign Application Priority Data

Feb. 13, 2012 (EP) ..... 12155245
Feb. 13, 2012 (EP) ..... 12155252
Feb. 13, 2012 (EP) ..... 12155254
Feb. 13, 2012 (EP) ..... 12155258

(58) Field of Classification Search
USPC ..... 131/329, 194, 195, 196, 335, 273, 128, 131/200.14, 202.21, 203.26, 203.27, 330, 131/175, 187, 201, 202, 215.2; 392/386
See application file for complete search history.

(56) References Cited

U.S. PATENT DOCUMENTS 4,612,491 A * 9/1986 McCarty ..... H02J 7/0042 320/107
4,788,988 A * 12/1988 Titus ..... A24F 1/30 131/173
5,269,327 A 12/1993 Counts et al.
5,878,752 A 3/1999 Adams et al.
6,042,414 A 3/2000 Kunert
6,053,176 A 4/2000 Adams et al.
9,220,304 B2 * 12/2015 Greim ..... H05B 3/02
9,883,700 B2 * 2/2018 Holzherr ..... A24F 47/008
2002/0005207 A1 1/2002 Wrenn et al.
2003/0226837 A1 12/2003 Blake et al.
2004/0020500 A1 2/2004 Wrenn et al.
2004/0025865 A1 2/2004 Nichols et al.
2004/0261802 A1 12/2004 Griffin et al.
2006/0196518 A1 9/2006 Hon
2006/0232926 A1 10/2006 Homer et al.
2007/0074734 A1 4/2007 Braunshteyn et al.
2008/0021072 A1 1/2008 Luzenberg
2008/0257367 A1 * 10/2008 Paterno ..... A24F 47/008 131/328
2009/0095287 A1 4/2009 Emarlou
2010/0006113 A1 1/2010 Urtsev et al.
2010/0126505 A1 5/2010 Rinker
2010/0307518 A1 12/2010 Wang
2010/0313901 A1 * 12/2010 Fernando ..... A24F 47/008 131/330
2011/0094523 A1 * 4/2011 Thorens ..... A24F 47/008 131/194
2011/0226266 A1 * 9/2011 Tao ..... A24F 3/00 131/185
2011/0265806 A1 11/2011 Alarcon et al.
2012/0090630 A1 4/2012 Hon
2016/0270450 A1 9/2016 Hon

FOREIGN PATENT DOCUMENTS

CN 201571500 U 9/2010
CN 101862038 A 10/2010
DE 203 14 626 U1 7/2004
DE 10 2007 011 120 A1 9/2008
EA 009116 B1 10/2007
EA 200701988 A1 6/2008
EP 1 618 803 A1 1/2006
EP 1 989 946 A1 11/2008
EP 2 253 233 A1 11/2010
FR 2 354 720 A1 1/1978
GB 741101 A 11/1955
GB 2 301 040 A 11/1996
JP 2006-524494 A 11/2006
KR 10-2010-0021595 A 2/2010
KR 10-1062248 B1 9/2011
RU 94 815 U1 6/2010
WO 2005/099494 A1 10/2005
WO WO 2007/098337 A2 8/2007

OTHER PUBLICATIONS

Extended European Search Report dated Oct. 26, 2012 in Patent Application No. 12150114.2.
Extended European Search Report dated Oct. 29, 2012 in Patent Application No. 12155245.9.
Extended European Search Report dated Oct. 29, 2012 in Patent Application No. 12155254.1.
Extended European Search Report dated Jul. 31, 2012 in Patent Application No. 12155252.5.
Extended European Search Report dated Aug. 29, 2012 in Patent Application No. 12155241.8.
International Search Report dated Jul. 12, 2013, in PCT/EP12/077084 filed Dec. 28, 2012.
Office Action dated Mar. 31, 2016 in Korean Patent Application No. 10-2014-7021388 (submitting English translation only).
Decision on Grant dated Dec. 23, 2016 in Russian Patent Application No. 2014132064/12(051516) (English translation only).
Written Opinion dated Oct. 1, 2015 in Singapore Patent Application No. 11201403801R.

* cited by examiner

AEROSOL-GENERATING DEVICE AND SYSTEM

CROSS REFERENCE TO RELATED APPLICATION

This application is a national phase application based on PCT/EP2012/077084, filed on Dec. 28, 2012.

The present disclosure relates to electrical systems in which a secondary device having a rechargeable source of electrical power is recharged by a primary device. In particular, the disclosure relates to a system comprising a portable aerosol-generating device that is connectable to a primary power supply device.

The present disclosure also relates to an aerosol-generating device with a polygonal cross-section, and in particular to an aerosol-generating device with an external cross-section defined by a shape having at least 5 sides. The disclosure further relates to an aerosol-generating device that is adapted to resist rolling. The disclosure also relates more generally to shaped aerosol-generating devices.

The present disclosure yet further relates to an aerosol-generating device having a stepped or tapered coupling portion for coupling to a charging device, and to a system comprising the aerosol-generating device and a charging device for receiving the aerosol-generating device.

The disclosure also relates to a system comprising the aerosol-generating device and a charging device for receiving the aerosol-generating device.

An example of an electrical system having a portable device and a primary charging device is an electrically operated smoking system. Electrically operated smoking systems significantly reduce sidestream smoke, as compared to lit-end smoking devices, while permitting a consumer to selectively activate the smoking system during the smoking experience. Electrically operated smoking systems typically include an aerosol-generating device having a housing for receiving an aerosol-generating article or a smoking article, heating elements to generate an aerosol, a power source and the necessary electronic circuitry. The circuitry may be, for example, circuitry for controlling the heating and charging of the aerosol-generating device. Having a portable device and primary charging device provides the advantage of a small aerosol generating device being the portable device that is easy to hold and use, but also the ability to quickly and conveniently recharge the aerosol generating device for repeated use.

It is an object of the invention to provide for enhanced operation of this type of electrical system.

The aim of smoking articles in which an aerosol-forming substrate, such as a tobacco containing substrate, is heated rather than combusted is to reduce known harmful smoke constituents produced by the combustion and pyrolytic degradation of tobacco in conventional cigarettes. Typically in such heated smoking articles, an aerosol is generated by the transfer of heat from a heat source to a physically separate aerosol-forming substrate or material, which may be located within, around or downstream of the heat source. During smoking, volatile compounds are released from the aerosol-forming substrate by heat transfer from the heat source and entrained in air drawn through the smoking article. As the released compounds cool, they condense to form an aerosol that is inhaled by the consumer.

A number of prior art documents disclose aerosol-generating devices for consuming or smoking heated smoking articles. Such devices include, for example, heated smoking systems and electrically heated smoking systems and smoking articles containing a tobacco-based aerosol-generating substrate consumed using such systems.

It would be desirable to provide an aerosol-generating device that is capable of dissipating the excess heat generated by the device during use. It would also be desirable to provide such an aerosol-generating device that is ergonomic to hold in use. It would also be desirable to provide such a device that remains stationary while not in use, for example, an aerosol-generating device that resists rolling when set down on a flat surface. A user may wish to place the device on a flat surface such as a table and, should the device roll, it may fall to the floor and be damaged. Furthermore, any aerosol-generating article in the process of being consumed may become soiled and need to be replaced.

It would be desirable to provide an aerosol-generating system comprising an aerosol-generating device and a secondary device for charging the aerosol-generating device that reduces the possibility of incorrectly connecting the aerosol-generating device to the secondary device. Providing such a charging device allows the aerosol-generating device to be smaller and lighter. The charging device may also provide means for storing information relating to the usage of the aerosol-generating device that is downloaded from the aerosol-generating device when coupled with the charging device. If the connections between the connections of an aerosol-generating device are incorrectly coupled to contacts of a secondary device, such as a charging device, damage may be done to electronics within one or both devices.

It would be desirable to provide an aerosol-generating system comprising an aerosol-generating device and a secondary device for charging the aerosol-generating device that facilitates the act of connecting the aerosol-generating device to the secondary device.

According to a first aspect of the present disclosure, there is provided an electrical system comprising a primary device and secondary device. The primary device comprises: a source of electrical power; a cavity configured to receive the secondary device; at least one electrical contact within the cavity configured to contact a corresponding contact on the secondary device when the secondary device is in the cavity, the at least one electrical contact being electrically connected to the source of electrical power; and at least one data contact configured to transfer data between the primary device and the secondary device. The secondary device is keyed to the cavity of the primary device.

Preferably, the keying comprises the cavity having a non-regular transverse cross-sectional shape, and the secondary device having a corresponding non-regular transverse cross-sectional shape. The non-regular transverse cross-sectional shape of the cavity may comprise a protrusion for keying with the non-regular transverse cross-sectional shape of the secondary device having a slot. Alternatively, the non-regular transverse cross-sectional shape of the cavity may comprise a slot for keying with the non-regular transverse cross-sectional shape of the secondary device having a protrusion.

Preferably, the secondary device comprises a coupling portion for coupling the secondary device to the at least one electrical contact and the at least one data contact, in which the coupling portion is stepped or tapered. The tapered or stepped portion may extend for between 5% and 20% of the length of the secondary device. The coupling portion may have a transverse cross-section that is non-circular, for example polygonal.

Preferably, the primary device further comprises a lid moveable between a first position to retain the secondary device in contact with the at least one electrical contact and the at least one data contact and a second position in which the secondary device is free to move out of contact with the at least one electrical contact and the at least one data contact. The primary device may be configured to prevent the supply of power to the secondary device through the at least one electrical contact when the lid is not in the first position. In the first position the lid may urge the secondary device into contact with the at least one electrical contact and the at least one data contact. At least one of the at least one electrical contact, and the at least one data contact preferably comprises a resilient element configured to urge the secondary device towards the lid when the secondary device is positioned in the cavity.

The lid may comprise at least one aperture allowing the escape of material from the cavity when the secondary device is in the cavity and the lid is in the first position.

Preferably, the source of electrical power in the primary device comprises a rechargeable battery.

Preferably, the secondary device is an electrically heated aerosol generating device comprising a heating element and a rechargeable power source. The primary device may be configured to provide power to the secondary device in a manner suitable to recharge the rechargeable battery in the secondary device when the secondary device is in contact with the at least one electrical contact.

According to a further aspect of the present disclosure, there is provided an electrical system comprising a primary device and secondary device, wherein the primary device comprises: a source of electrical power; a cavity configured to receive the secondary device; at least one electrical contact within the cavity configured to contact a corresponding contact on the secondary device when the secondary device is in the cavity, the at least one electrical contact being electrically connected to the source of electrical power; and a lid moveable between a first position to retain the secondary device in contact with the at least one electrical contact and a second position in which the secondary device is free to move out of contact with the at least one electrical contact.

Such a system, advantageously, allows for reliable and efficient charging of the secondary device through ensured electrical contact between the primary device and the secondary device.

The primary device is preferably configured to prevent the supply of power to the secondary device through the at least one electrical contact when the lid is not in the first position. By preventing the supply of power to the secondary device when the lid is not in the first position, the use of the secondary device when power is being supplied to the secondary device can be prevented.

The primary device may be configured to prevent the supply of power to the secondary device by ensuring a very high resistance between the at least one electrical contact and the secondary device when the lid is not in the first position. The primary device may be configured to prevent contact between the at least one electrical contact and the secondary device when the lid is not in the first position. The primary device may be configured to prevent a complete electrical connection being made between the primary device and the secondary device when the lid is not in the first position. By complete electrical connection it is meant that electricity is able to flow between the primary device and the secondary device.

In one alternative, the lid preferably comprises a means for preventing the supply of power to the secondary device when the lid is not in the first position. Preferably, the power prevention means comprises a switch. The switch may be a physical contact switch adapted to be closed when the lid is in the first position. The switch is in electrical connection with the power supply, and allows the supply of power to the secondary device when in the closed position. The switch may be a reed switch, where the reed switch is provided in the primary device adjacent the opening of the cavity, and the activating magnet is provided in the lid. The magnet is positioned in the lid such that when the lid is in the first position the magnet activates the reed switch allowing the supply of power to the secondary device. Alternatively, a Hall Effect transducer may be utilised. In this alternative, the Hall Effect transducer is positioned in the primary device adjacent the opening of the cavity. A magnet is provided in the lid such that when the lid is in the first position the magnet activates the Hall Effect transducer allowing the supply of power to the secondary device.

Preferably, in the first position the lid urges the secondary device into contact with the at least one electrical contact. By urging the secondary device into contact with the at least one electrical contact, the electrical resistance between the contact and the secondary device may be significantly reduced, and thus allow the supply of power to the secondary device.

As used herein, the term 'urges' or 'urging' means that a force is applied by one component to another component.

As used herein, the term 'resilient element' relates to an element that may be deformed or deflected by an applied force, but is capable of returning to its original position or state after the applied force is removed. When a resilient element is deformed or deflected by a force applied by a component moving towards the resilient element, the resilient element generates a reactive force that urges the component to move away from the resilient element. Examples of resilient elements include helical springs and cantilever springs.

Preferably, the electrical system further comprises at least one resilient element configured to urge the secondary device towards the lid when the secondary device is positioned in the cavity. Preferably, the at least one resilient element is configured to urge the secondary device towards the lid when the lid is in the first position. Preferably, the at least one resilient element is configured not to urge the secondary device towards the lid when the lid is in the second position. The resilient element may be configured to urge the secondary device at least partially out of the cavity when the lid is in the second position. By urging the secondary device at least partially out of the cavity, the secondary device may be more easily removed from the primary device. The at least one electrical contact is preferably the at least one resilient element.

Preferably, the cavity is an elongate cavity extending from the top of the primary device. The length of the cavity from its open end to its closed end is preferably at least as long as the secondary device.

Preferably, the electrical system further comprises a plurality of electrical contacts electrically connected to the source of electrical power. The electrical system may comprise two electrical contacts, a first electrical contact being connected to the positive terminal of the power supply, and a second electrical contact being connected to the negative terminal of the power supply.

In a further alternative, the supply of power is prevented by providing one resilient movable electrical contact, and one non-movable electrical contact. The movable electrical contact is configured to prevent the second non-movable electrical from engaging with the secondary device when the lid is not in the first position. This prevents the formation of a complete electrical connection until the lid is closed.

The electrical contacts are preferably made from metal. Preferably, the metal used to make the electrical contacts is copper beryllium. Preferably, at least a portion of the electrical contact is gold plated.

Preferably, the source of electrical power comprises a rechargeable battery. Preferably, the primary device comprises means for receiving external electrical power to recharge the rechargeable battery.

Preferably, the electrical power supply device is configured to provide power to the secondary device in a manner suitable to recharge a secondary battery in the secondary device.

The first position of the lid is preferably a closed position, and the second position of the lid is preferably an open position. When the lid is in the closed position, access to the secondary device is preferably substantially prevented. Furthermore, when the lid is in the closed position, preferably the secondary device cannot be removed from the primary device.

Preferably, the primary device further comprises a housing, wherein the lid is attached to the housing in both the first and second positions.

The housing preferably comprises a front wall, a back wall, a bottom wall, a top wall, a first side wall and a second side wall.

The terms "front", "back", "upper", "lower", "side", "top", "bottom", "left", "right" and other terms used to describe relative positions of the components of the primary device and secondary device refer to the primary device in an upright position with the opening of the cavity configured to receive the secondary device at the top end.

The term "longitudinal" refers to a direction from bottom to top or vice versa. The term "transverse" refers to a direction perpendicular to the longitudinal direction.

The primary device may be a substantially rectangular parallelepiped comprising two wider walls spaced apart by two narrower side walls and top and bottom walls. The secondary device is preferably elongate.

The lid is preferably a hinge lid. Preferably, the hinge extends across the top of the housing from the front wall to the back wall. The hinge may comprise a spring configured to retain the lid in the first position. The hinge may also comprise a damper configured to damp the motion of the lid when the lid is moved from the second position to the first position. Alternatively, the hinge may comprise a spring configured to retain the lid in the second position. In this alternative, the lid is preferably provided with means for retaining the lid in the first position, the retaining means being configured to provide sufficient force to overcome the force applied to the lid by the spring.

The retaining means may comprise at least one magnet and at least one corresponding ferrous element. The at least one magnet being provided in the housing of the primary device, and the ferrous element being provided in the lid. Alternatively, the retaining means may be a latch type arrangement.

The hinge lid may form the entire top of the housing. In this alternative, the hinge may be internal to the lid, and be adjacent a side wall of the housing.

Preferably, the secondary device is an electrically heated aerosol generating device. The aerosol generating device is designed to receive an aerosol generating article and be held by a user during the smoking experience. A power supply is preferably provided in the secondary device and is adapted to heat up the aerosol-forming substrate to operating temperature before aerosol generating begins. The power supply in the secondary device is also adapted to maintain the temperature of the aerosol-forming substrate during the aerosol generation. The source of electrical power in the primary device is preferably used to charge the secondary power supply during a charging mode when the secondary device is not in use.

The secondary device, in the form of an electrically heated aerosol generating device, is preferably of a similar size to or slightly larger than a lit-end cigarette. Thus, the secondary unit can be held between the user's fingers in a similar way to a lit-end cigarette.

Preferably, the secondary device comprises an electrical heating element, and the primary device is configured to be capable of providing power to the secondary device when the lid is in the first position to heat the electrical heating element to thermally liberate organic materials adhered to or deposited on the heating element. In use, an aerosol generating article is provided in the secondary device, in the form of an aerosol generating substrate. When the aerosol generating article is removed from the secondary device it may leave residue on the heater of the secondary device, and by heating the electrical heater to a temperature sufficient to liberate that organic residue the heater may be cleaned. This operation may be performed by the user activating a switch on the primary device, or after a predetermined number of charges of the secondary device, or either.

The presence of organic material or residue on a heating element may impair the user experience when consuming aerosol generating articles such as smoking articles. Thus, it may be preferred that the heater or heating elements of an aerosol-generating device (i.e. a secondary device) are regularly cleaned. Either the primary device or the aerosol-generating device may comprise an indicator that warns a user that the device is due to undergo a cleaning cycle. A controller located in either the aerosol-generating device or the primary device may determine when the device has undergone a predetermined number of smoking cycles without undergoing a cleaning cycle and may activate the indicator. If the user does not activate a cleaning cycle within a predetermined number of smoking cycles after the indicator has been activated, the user may be prevented from consuming further articles before a cleaning cycle is performed. Such a cleaning cycle may need to be manually activated or may occur automatically when the aerosol-generating device is loaded into the primary device after the need for cleaning has been determined. By preventing operation of the aerosol-generating device when there is a need for cleaning, a more pleasurable user experience may be delivered more consistently.

Preferably, the lid comprises at least one aperture allowing the escape of material from the cavity when the secondary device is in the cavity and the lid is in the first position. The aperture is preferably configured to allow the egress of the liberated organic material. Providing at least one aperture in the lid advantageously allows the venting of the cavity within the primary device to reduce build up of deposits.

Preferably, the secondary device is configured to operate in at least three modes. The at least three modes are preferably a charging mode, a cleaning mode, and an operating mode. The charging mode, and the cleaning mode are preferably only accessible when the secondary device is within the primary device and the lid is in the first position. The operating, that is to say aerosol generating, mode is preferably only available when the secondary device is not within the primary device.

Preferably, the secondary device comprises a rechargeable battery and the primary device is configured to provide power to the secondary device in a manner suitable to recharge the rechargeable battery in the secondary device when the secondary device is in contact with the at least one electrical contact.

Preferably, the secondary power supply is chargeable by the primary power supply, during the charging mode, so that the secondary power supply has sufficient charge to maintain the temperature of the aerosol-forming substrate at substantially the operating temperature during the smoking mode. If an optimum temperature is not reached then the amount and quality of an aerosol generated during operation of the device may be diminished. For example, different proportions of volatile elements may be generated when the heating element heats an aerosol-forming substrate to a lower temperature compared to when the substrate is heated to an optimum temperature, and this may alter the flavour of the aerosol. In order to deliver a more optimal and consistent user experience, it may be preferred that the secondary device can only be operated when the secondary power supply is in a fully charged condition. In the fully charged condition the secondary power supply should always be capable of heating the aerosol-forming substrate to an optimum temperature. As every operation of the secondary device will consume power from the secondary power supply, it may be preferred that the secondary device needs to be recharged before each operation. For example, an aerosol-generating device may be required to be recharged after every actuation before another smoking article can be consumed.

Insufficient charge may also result in an unsatisfactory user experience if the secondary device fails to have sufficient charge to heat the aerosol generating substrate over a time period sufficient to exhaust or substantially deplete the substrate of any aerosol that might be formed. Accordingly, in one embodiment the secondary device will prevent a user from beginning operation of the device unless sufficient power is available to complete an aerosol generating cycle. For example, if the aerosol generating is a smoking article including an tobacco based aerosol generating substrate, the secondary device may not permit a smoking experience unless sufficient power is present to maintain an operating temperature for at least 6 minutes.

Preferably, supply of electrical power from the primary power supply to the at least one heating element, during a pre-heating mode, is controlled by the secondary circuitry in the secondary device. Supply of electrical power from the primary power supply, during the charging mode, to charge the secondary power supply, may be controlled by the secondary circuitry in the secondary device.

The secondary device may be keyed to the cavity of the primary device such that only a secondary device compatible with the primary device can be inserted into the cavity. To effect the keying of the secondary device to the cavity of the primary device, the cavity may be provided with a specific non-regular shape, and the secondary device may be provided with a corresponding non-regular shape. In addition, to ensure the secondary device is inserted into the cavity in the correct orientation, the non-regular shape is preferably not rotationally symmetrical. As such, the secondary device may only be inserted into the cavity in one orientation.

The primary device may further comprise at least one contact configured to transfer data between the primary device and the secondary device. Preferably, the primary device further comprises at least two contacts configured to transfer data between the primary device and the secondary device. The primary device is preferably configured to only transfer data to, or receive data from, the secondary device when the lid is in the first position.

The at least one data transfer contact is preferably a resilient element. Preferably, the at least one data transfer contact is configured to prevent the supply of power to the secondary device when the lid is not in the first position. The at least one resilient data transfer contact is preferably movable from a first neutral position when the lid is in the second position, in which the at least one power supply electrical contact is not engaged with the secondary device, to a second deflected position when the lid is in the first position, in which the at least one data electrical contact and the at least one power supply electrical contact is are both in electrical contact with the secondary device.

Data may be communicated between both the secondary and primary device, as well as from the primary device to a computer interface capable of being read by a computer or other electronic device capable of transferring data to a computer or the internet. Preferably, the data connection operates under an interface standard. An interface standard is a standard that describes one or more functional characteristics, such as code conversion, line assignments, or protocol compliance, or physical characteristics, such as electrical, mechanical, or optical characteristics, necessary to allow the exchange of information between two or more systems or pieces of equipment. Examples of suitable interface standards for the communications link include, but are not limited to, the Recommended Standard 232 (RS-232) family of standards; USB; Bluetooth; FireWire (a brand name of Apple, Inc for their IEEE 1394 interface), IrDA (Infrared Data Association—a communications standard for the short-range exchange of data by Infrared light); Zigbee (a specification based on the IEEE 802.15.4 standard for wireless personal area networks) and other Wi-Fi standards.

According to another aspect of the present disclosure, there is provided an electrical system comprising a primary device and secondary device, wherein the primary device comprises: a source of electrical power; a cavity configured to receive the secondary device; at least one electrical contact within the cavity configured to contact a corresponding contact on the secondary device when the secondary device is in the cavity, the at least one electrical contact being electrically connected to the source of electrical power; and a lid moveable between a first position to retain the secondary device in the cavity and a second position in which the secondary device is free to move out of the cavity, wherein the lid comprises at least one aperture that allows material to escape from the cavity when the lid is in the first position.

The lid may be retained in the first position by mechanical means, such as a clasp, or by magnetic latching means. The lid may be retained in the first position by means of a spring closure force. For example, the lid may have a hinge that incorporates a locking mechanism. It may be preferable that the lid has a hinge that incorporates a damping mechanism to help prevent damage to the lid while the lid moves between the first position and the second position. The lid may, therefore, have a hinge that incorporates a rotary damper or a barrel damper mechanism.

According to a yet further aspect of the present disclosure, there is provided an aerosol generating system comprising an aerosol-forming substrate and an electrical system as described herein. The secondary device is an aerosol generating device that is configured to receive the aerosol-forming substrate. The lid is prevented from moving to the first position when the secondary device is in the cavity and the aerosol-forming substrate is received in the secondary device.

According to a still further aspect of the present disclosure, there is provided an aerosol generating device, comprising a heating element for heating an aerosol-forming substrate to form an aerosol; a rechargeable battery coupled to the heating element and configured to supply power to the heating element; and a controller coupled to the rechargeable battery, the controller configured to prevent activation of the heating element unless the rechargeable battery is charged above a predetermined threshold level. The elements comprised in the aerosol-generating device are preferably retained within a housing that also defines a substrate receiving chamber for receiving and locating an aerosol-forming substrate in proximity or contact with the heating element. It may be advantageous that the aerosol-forming substrate is a component element of an aerosol-generating article configured to be received in the substrate receiving cavity.

In one embodiment of the aerosol-generating device, the controller is configured to prevent operation of the heating element for a predetermined period after previous activation of the heating element. Alternatively, or in addition, the controller may be configured to prevent operation of the heating element based on a charge level of the rechargeable battery or based on an amount of power consumption following activation of the heating element. As discussed above, the amount and quality of an aerosol generated during operation may be impaired if the charge levels of the rechargeable battery are not sufficient to apply a predetermined thermal cycle to the aerosol-forming substrate.

The primary device may include a display (for example a digital display) indicating information to the user. For example, the display may indicate smoking article consumption, energy usage or other information. The display may further indicate when the secondary power supply has sufficient charge to be used to consume a smoking article.

According to a yet still further aspect of the present disclosure, there is provided an aerosol generating device comprising: a heating element; a power source coupled to the heating element and configured to supply power to the heating element; and a controller coupled to the heating element, the controller configured to control the supply of power to the heating element in a first mode to perform an aerosol generating cycle and in a second mode to perform a cleaning cycle, the controller further configured to monitor operation of the device and to prevent the supply of power in a first mode following performance of a threshold number of consecutive aerosol generating cycles without performance of a cleaning cycle. The elements comprised in the aerosol-generating device are preferably retained within a housing that also defines a substrate receiving chamber for receiving and locating an aerosol-forming substrate in proximity or contact with the heating element. It may be advantageous that the aerosol-forming substrate is a component element of an aerosol-generating article configured to be received in the substrate receiving cavity.

The aerosol-forming substrate preferably comprises a tobacco-containing material containing volatile tobacco flavour compounds which are released from the substrate upon heating. Alternatively, the aerosol-forming substrate may comprise a non-tobacco material. Preferably, the aerosol-forming substrate further comprises an aerosol former. Examples of suitable aerosol formers are glycerine and propylene glycol.

The aerosol-forming substrate may be a solid substrate. The solid substrate may comprise, for example, one or more of: powder, granules, pellets, shreds, spaghettis, strips or sheets containing one or more of: herb leaf, tobacco leaf, fragments of tobacco ribs, reconstituted tobacco, homogenised tobacco, extruded tobacco and expanded tobacco. Optionally, the solid substrate may contain additional tobacco or non-tobacco volatile flavour compounds, to be released upon heating of the substrate. Optionally, the solid substrate may be provided on or embedded in a thermally stable carrier. The carrier may take the form of powder, granules, pellets, shreds, spaghettis, strips or sheets. Alternatively, the carrier may be a tubular carrier having a thin layer of the solid substrate deposited on its inner surface, or on its outer surface, or on both its inner and outer surfaces. Such a tubular carrier may be formed of, for example, a paper, or paper like material, a non-woven carbon fibre mat, a low mass open mesh metallic screen, or a perforated metallic foil or any other thermally stable polymer matrix. The solid substrate may be deposited on the surface of the carrier in the form of, for example, a sheet, foam, gel or slurry. The solid substrate may be deposited on the entire surface of the carrier, or alternatively, may be deposited in a pattern in order to provide a non-uniform flavour delivery during use. Alternatively, the carrier may be a non-woven fabric or fibre bundle into which tobacco components have been incorporated. The non-woven fabric or fibre bundle may comprise, for example, carbon fibres, natural cellulose fibres, or cellulose derivative fibres.

The aerosol-forming substrate may be a liquid substrate and the smoking article may comprise means for retaining the liquid substrate. The aerosol-forming substrate may alternatively be any other sort of substrate, for example, a gas substrate, or any combination of the various types of substrate.

The primary unit may include storage means for at least one aerosol generating article, such as a smoking article including a tobacco aerosol forming substrate. The storage means may include storage for used smoking articles, unused smoking articles or both. This is advantageous since the primary unit and secondary unit together provide all the components required for the smoking mode.

One aspect may provide an aerosol-generating system comprising an aerosol-generating device for consumption of an aerosol-generating article, the aerosol-generating device comprising a heating element and a rechargeable power supply for powering the heating element, and a charging device for coupling to the aerosol-generating device to recharge the power supply and clean the heating element, in which the system is configured to prevent consumption of an aerosol-generating article when the aerosol-generating device is coupled to the charging device. The aerosol-generating device may be any aerosol-generating device or any secondary device as described herein. The charging device may be any charging device or primary device as described herein. The aerosol-generating article may be any aerosol-generating article or smoking article as described herein. The system may comprise a mechanical means for preventing consumption of an aerosol-generating article when the aerosol-generating device is coupled to the charging device. For example, it may not be possible to actuate the heating element when the aerosol-generating device is coupled to the charging device unless the aerosol-generating device is enclosed within the charging device by a lid. The lid is not able to close if the aerosol-generating device is coupled to an aerosol-generating article. The system may comprise electrical or software means for preventing consumption of an aerosol-generating article when the aerosol-generating device is coupled to the charging device. For example, sensors may detect the presence of an aerosol-generating article when the aerosol-generating device is coupled to the charging device and a controller may then prevent actuation of the heating element.

One aspect may provide an aerosol-generating device comprising a heating element and a power supply for powering the heating element, in which the device is configured to prevent actuation of the heating element unless the power supply has greater than a predetermined level of charge available for powering the heating element. It may be preferred that actuation of the heating element only occurs when the power supply is fully charged. The aerosol-generating device may be any aerosol-generating device or any secondary device as described herein.

One aspect may provide a method of delivering a consistent user experience to a consumer of an aerosol-generating article, the article being consumed by heating in an aerosol-generating device comprising a heating element and a power supply for powering the heating element, the method comprising the steps of, determining the charge level of the power supply, and only actuating the heating element if the charge available exceeds a predetermined threshold. The aerosol-generating device may be any aerosol-generating device or any secondary device as described herein. The aerosol-generating article may be any aerosol-generating article or smoking article as described herein.

One aspect may provide an aerosol-generating system comprising an aerosol-generating device for consumption of an aerosol-generating article, the aerosol-generating device comprising a heating element and a rechargeable power supply for powering the heating element, and a charging device for coupling to the aerosol-generating device to recharge the power supply and clean the heating element, in which the system is configured such that a user is prevented from consuming more than a predetermined number of aerosol-generating articles without cleaning the heating element when the aerosol-generating device is coupled to the charging device.

In a further aspect there is provided an elongate aerosol-generating device having a polygonal transverse cross-section. The polygon comprises at least 6 sides.

By providing an aerosol-generating device with such a multi-faceted cross-section the surface area of the device is increased as compared to a device having a circular cross-section. Utilising a polygon with at least 6 sides advantageously provides a user with a more ergonomic feel, while increasing the surface area for heat dissipation.

In addition, providing a polygonal cross-section, with straight sides, advantageously increases the stability of the device when it is placed on a surface while it is not in use.

The polygon may comprise between 6 and 16 sides, preferably between 7 and 12 sides. In one preferred embodiment the polygon comprises 10 sides.

The polygon may be a regular polygon. The term regular polygon refers to a polygon that is equiangular, all of the angles are the same, and equilateral, all of the sides are the same length. The aerosol-generating device may have a regular polygonal transverse cross-section along its entire length. Alternatively, the aerosol-generating device may have a regular polygonal cross-section that extends along only a portion of its length. Where the regular polygonal cross-section does not extend along the entire length of the aerosol-generating device, for example, the cross-section of the aerosol-generating device may change due to a button, such as a button incorporated into the aerosol-generating device, such as a button adapted to activate the device in use.

As used herein, the term "length" refers to the dimension in the longitudinal direction. The term "longitudinal" refers to the main axis of the elongate aerosol-generating device. As used herein, the term "transverse" refers to a direction perpendicular to the longitudinal direction.

At least one end of the aerosol-generating device may be tapered. Alternatively, both ends of the aerosol-generating device may be tapered. Preferably, the radius of the or each end face of the tapered end is at least 50% of the maximum radius of the aerosol-generating device. The radius of a polygon is measured from the centroid of the polygon to a vertex thereof.

Where the at least one end of the aerosol-generating device is tapered, preferably, the or each end of the aerosol-generating device is tapered along at least about 5% of the length of the device. More preferably, the at least one end of the aerosol-generating device is tapered along at least about 7% of the length of the device. Yet more preferably, the at least one end of the aerosol-generating device is tapered along at least about 7.5%.

As used herein, the term "length" refers to the dimension in the longitudinal direction. The term "longitudinal" refers to the main axis of the elongate aerosol-generating device. As used herein, the term "transverse" refers to a direction perpendicular to the longitudinal direction.

Where the at least one end of the aerosol-generating device is tapered, the taper may be linear or curved.

Preferably, the elongate aerosol-generating device comprises an outer housing having a substrate receiving cavity adapted to receive an aerosol-generating substrate, a heating element adapted to heat an aerosol-generating substrate to generate an aerosol, and a power supply adapted to provide power to the heating element. The device may also comprise a controller for controlling the power supplied from the power supply to the heating element.

Where the aerosol-generating device comprises a substrate receiving cavity, a holder may be provided within the cavity. The holder is adapted to hold an aerosol-generating substrate adjacent the end of the aerosol-generating device having the cavity. A plurality of air inlets to a plurality of air channels within the device may be formed the holder and the outer housing portion. The air channels may diverge away from the air inlets within the device as the outer housing diverges with the tapering. Providing such air channels may improve the air entrainment within the device. In addition, the entrained air may improve the insulation between the aerosol-generating substrate and the outer housing.

The substrate receiving cavity may be adapted to receive a smoking article comprising an aerosol-generating substrate having a mouth end and a distal end, the aerosol-generating substrate being at the distal end.

In use, a user applies his or her lips to the mouth end of the smoking article and inhales while activating the device. Air and any aerosol-generated within the device are drawn through the mouth end of the smoking article to be inhaled by the user. When the user inhales, air and aerosol move through the smoking article from the distal end to the mouth end. In some embodiments, air may be drawn into the device through the end of the device proximal to the smoking article. In some embodiments, air may be drawn into the device through a sidewall. In other embodiments, air may be drawn into the device through a combination of the proximal end of the device and a sidewall of the device.

The smoking article may be substantially cylindrical in shape. The smoking article may be substantially elongate.

The smoking article may also have a length and a circumference substantially perpendicular to the length. The smoking article substrate may be received in the cavity of the aerosol-generating device such that the length of the smoking article is substantially parallel to the airflow direction in the aerosol-generating device.

The outer housing of the aerosol-generating device may be manufactured from two, four or more portions. The portions are preferably joined together along a transverse cross-section of the device, and may be adapted to join around a button on the device. Where the outer housing comprises four portions, the portions may be two tapered end portions, and two substantially cylindrical central portions. The outer housing of the aerosol-generating system may be manufactured from any suitable material or combination of materials. Examples of suitable materials include, but are not limited to, metals, alloys, plastics or composite materials containing one or more of those materials, or thermoplastics that are suitable for food or pharmaceutical applications, for example polypropylene, polyetheretherketone (PEEK) and polyethylene.

In a further aspect, there is also provided an aerosol-generating system. The system comprises an elongate aerosol-generating device as described above, and a charging device comprising a cavity having a polygonal transverse cross-section corresponding to the polygonal transverse cross-section of the aerosol-generating device, the cavity being adapted to receive the elongate aerosol-generating device.

Preferably, the aerosol-generating device receiving cavity comprises means for keying the aerosol-generating device to the charging device. The keying means may comprise at least one notch for receiving at least one corresponding protrusion on the aerosol-generating device. The at least one protrusion may be a button adapted to activate the aerosol-generating device.

In one embodiment where the aerosol-generating device comprises at least one tapered end, the tapered end enables the device to be more easily inserted into the cavity of the charging device.

In a yet further aspect there is provided an elongate aerosol-generating device in which at least a portion of the device has a transverse external cross-section defined by a shape having at least five sides. It is preferred that the aerosol-generating device has a high aspect ratio and that a substantial proportion of the length has the defined cross-section. The entire length of the device may have the defined transverse cross-section.

The external cross-section may be a polygonal transverse cross-section. The polygon comprises at least five sides. The polygon may comprise at least six sides.

The cross-sectional shape, for example a polygon, may comprise between 6 and 16 sides, preferably between 7 and 12 sides. In one preferred embodiment the shape is a polygon comprising 10 sides.

The polygon may be a regular polygon. The term regular polygon refers to a polygon that is equiangular, all of the angles are the same, and equilateral, all of the sides are the same length. The sides may be straight or slightly curved. The angles may be formed by sharp corners or rounded corners. The aerosol-generating device may have a regular polygonal transverse cross-section along its entire length. Alternatively, the aerosol-generating device may have a regular polygonal cross-section that extends along only a portion of its length. For example, the cross-section of the aerosol-generating device may change due to the presence of a button. Such a button may be adapted to activate the device in use. The position of the button may be chosen so as to facilitate presentation of the button on an uppermost surface regardless of the shape of the device.

The device may be greater than 60 mm in length. The device may be less than 150 mm in length. For example, the device may be between 80 mm and 120 mm in length. The device may be between 90 mm and 110 mm in length.

An outer circumcircle of the transverse cross-sectional shape may have a diameter of greater than 10 mm. An outer circumcircle of the transverse cross-sectional shape may have a diameter of less than 20 mm. An outer circumcircle of the transverse cross-sectional shape may have a diameter of between 12 mm and 16 mm. The cross-section of a polygon may be defined by line passing from one edge of the polygon, through the centre of the polygon, and to an opposing edge. The length of this line may be between 10 mm and 20 mm, preferably between 12 mm and 15 mm. An even sided polygon may have a cross-sectional line that passes from a flat face of the polygon to an opposing flat face of the polygon. This distance may be, for example between 12 mm and 14 mm. An even sided polygon may have a cross-sectional line that passes from a corner of the polygon to an opposing corner of the polygon. This distance may be, for example between 12 mm and 14 mm. The corner to corner cross-section will be slightly longer than the face to face cross-section.

The sides of the cross-sectional shape may all have equal length. The sides of the cross-sectional shape may have differing lengths. Preferably one or more sides have a length greater than 2 mm, preferably greater than 3 mm or greater than 4 mm. It may be advantageous for one or more sides to have a length greater than 5 mm. The length of a side of the cross-sectional shape may be the same as a width of a facet of the three-dimensional device. For example, if the device is substantially cylindrical and has a cross-section that is an equilateral hexagon with sides of length 5 mm, the device will have six longitudinal facets of 5 mm width.

The transverse cross-sectional shape preferably has at least five corners joined by either straight lines or curves to form the shape having at least five sides. Where the corners are joined by curves it is preferable that the curves have a large radius compared to the length of the side so that the side only slightly deviates from linear and gives the appearance of being almost flat.

The aerosol-generating device may be substantially cylindrical. The term cylindrical as used herein describes a three-dimensional shape that has substantially parallel sides and a base defined by a two-dimensional shape. The two-dimensional shape is that defined for the transverse cross-section, i.e., a shape having at least five sides. The term cylinder as used herein may be equivalent to the term prismatic. By substantially parallel it is meant that the sides do not need to be precisely parallel. For example, the sides may be within plus or minus 5 degrees from true parallel.

A portion of the aerosol-generating device may be shaped as an elongate frusto-pyramid having converging sides and a base defined by a two-dimensional shape. The two-dimensional shape is that defined for the transverse cross-section, i.e., a shape having at least 5 sides.

Preferably, each of the sides of the 2-dimensional shape defining the cross-section corresponds to an elongated face on an external surface of the device.

By providing an aerosol-generating device with such a multi-faceted cross-sectional shape the surface area of the device is increased as compared to a device having a circular cross-section. For example, a device that is substantially cylindrical and having a transverse cross-section in the shape of a polygon with at least 5 sides advantageously provides a user with a more ergonomic feel, while increasing the stability of the device when it is placed on a surface while it is not in use. It is anticipated that a user may wish to place the device on a flat surface, for example a table. If the device were to roll, the user may be inconvenienced. A device comprising shape features that help stabilise the device and resist rolling will be advantageous.

Where the, or each, end of the aerosol-generating device is tapered, the taper may be linear or curved. The presence of a taper may be particularly advantageous where one end of the device is configured to be inserted into and couple with another device. For example, one or more electrical contacts may be located at or near a first end of the device such that they can be brought into contact with electrical contacts located within a receiving cavity of another device. A tapered end of the device, in conjunction with a mating receiving portion, allows the device to be coupled swiftly and easily by a user. The taper guides the device into a correct position within the receiving cavity. Due to the guiding effect provided by the taper, it is possible for a user to couple the device to another device, for example a charging unit, without looking at the device to align the contacts. This may be advantageous as the act of coupling the device to another device can be carried out in the dark or while a user is engaged in conversation.

The user of an aerosol-generating device may wish to rest the device on a surface when consuming an aerosol-generating article. It may be undesirable to lay the device down as a mouth end of the article may then come into close proximity to the surface, which may be unhygienic. It may be preferable to lean the device such that the mouth end of the article is raised from the surface. Advantageously, the presence of a taper may facilitate the leaning of the device in contact with both the surface and a stationary object raised above the surface. The taper, in conjunction with a shaped cross-section, causes a large surface area to be in contact with the surface when the device is leant at an appropriate angle. This may increase the stability of the device when it is leant at an angle. The optimum leaning angle may depend on the angle of the taper. An optimum leaning angle may, for example, be between 25 degrees and 60 degrees from the surface.

Preferably, the elongate aerosol-generating device comprises an outer housing having a substrate receiving cavity adapted to receive an aerosol-generating article including an aerosol-generating substrate, a heating element adapted to heat an aerosol-generating substrate to generate an aerosol, and a power supply adapted to provide power to the heating element. The device may also comprise a controller for controlling the power supplied from the power supply to the heating element.

Where the aerosol-generating device comprises a substrate receiving cavity, a holder may be provided within the cavity. The holder is adapted to hold an aerosol-forming substrate adjacent the end of the aerosol-generating device having the cavity. The aerosol-forming substrate is itself preferably a component part of an aerosol-generating article that is receivable in the holder.

The external shape of the device may be defined by a housing. The housing may form a shell retaining component parts of the device. The housing may have an internal cross-section that is the same shape as its external cross-section. The housing may have an internal cross-section that is circular. The housing may have an internal cross-section that is non-circular and of different shape to the external cross-section.

Where the device comprises a holder adapted to hold an aerosol-generating article including an aerosol-generating substrate, a plurality of air inlets leading to a plurality of air channels within the device may be formed by a space between the holder and the outer housing portion. For example, the holder may have a circular external cross-section and the housing may have a decagonal internal cross-section. If the holder is fitted within the housing such that an outer portion of the holder contacts each of the ten inner faces of the internal surface of the housing, ten gaps are defined by spaces between corners of the decagon and the holder. These gaps may act as air inlets. The area of air inlets may be controlled by selecting the internal shape of the housing, or selecting the internal shape of the housing in the portion of housing defining the substrate receiving cavity.

The air channels may diverge away from the air inlets within the device as the outer housing diverges with tapering. Providing such air channels may improve the air entrainment within the device. In addition, the entrained air may improve the insulation between the aerosol-forming substrate and the outer housing.

The substrate receiving cavity may be adapted to receive an aerosol-generating article having a mouth end and a distal end, an aerosol-forming substrate being located at the distal end. The distal end of the aerosol-generating article is inserted into the substrate receiving cavity.

In use, a user inserts an aerosol-generating article into the substrate receiving cavity of the device, activates the device, applies his or her lips to the mouth end of the aerosol-generating article, and inhales. Air and any aerosol generated within the device are drawn through the mouth end of the aerosol-generating article to be inhaled by the user. When the user inhales, air and aerosol move through the aerosol-generating article from the distal end to the mouth end. In some embodiments, air may be drawn into the device through the end of the device proximal to the aerosol-generating article. In some embodiments, air may be drawn into the device through a sidewall. In other embodiments, air may be drawn into the device through a combination of the proximal end of the device and a sidewall of the device.

The aerosol-generating article may be substantially cylindrical in shape. The aerosol-generating article may be substantially elongate. The aerosol-generating article may also have a length and a circumference substantially perpendicular to the length. The aerosol-generating article may be received in the cavity of the aerosol-generating device such that the length of the aerosol-generating article is substantially parallel to the airflow direction in the aerosol-generating device.

Where the aerosol-generating device has a housing, the housing may be an elongate shell having a length of between 60 mm and 150 mm. The housing may have a wall thickness of between 0.2 mm and 1 mm. If the housing is formed from a metallic material the wall thickness is preferably between 0.2 mm and 0.4 mm. If the housing is formed from a polymer the wall thickness is preferably between 0.5 mm and 1 mm, for example between 0.6 mm and 0.8 mm, or about 0.75 mm.

The outer housing of the aerosol-generating device may be manufactured from two, four or more portions. The portions are preferably joined together along a transverse cross-section of the device, and may be adapted to join around one or more buttons protruding from the device. Where the outer housing comprises four portions, the portions may be two tapered end portions, and two substantially cylindrical central portions. In some embodiments a first housing portion may define the external shape of a first end of the device and a second housing portion may define the external shape of a second end of the device. Two adjacent housing portions may meet at a join situated approximately half-way along the length of the device. Two housing portions may meet at a join that lies closer to one end of the device than the other. Preferably the housing portions are separable, for example a first housing portion may be capable of being separated from a second housing portion by sliding the housing portions apart in a longitudinal direction. Access to an internal portion of the device may be obtained by removing one or more portions of housing.

It may be preferable that the aerosol-generating device comprises a housing portion that is fixed to internal components of the device, and cannot be removed from the device, and a further housing portion that can be removed from the device. It may be preferable that an end of the device that comprises the substrate receiving cavity may be removable from the device. Any holder within the substrate receiving cavity may be removed with the housing portion. Removal of a portion of the housing may be desirable in order to access inner component parts of the device, for example to clean the device. Movement of a housing portion, or removal of a housing portion may also be desirable in order to assist removal of aerosol-generating articles after use of the device.

Where a housing portion is removable from the device it may be desirable that the housing portion should only be couplable to the device in a specific orientation. The removable housing portion may, for example, slide over a substantially cylindrical inner portion of the device. In such circumstances an inner surface of the housing may define a notch or a protrusion that keys with a corresponding protrusion or notch on the inner portion to ensure that the housing portion may only be coupled to the aerosol-generating device in a specific orientation.

Where a housing portion is slideable with respect to inner components of the device, it may be advantageous if the housing portion can be retained in one or more stable positions. To this effect the inner surface of the housing portion may comprise protrusions that engage with a protrusion defined on an inner portion of the device to act as snaps. For example, two longitudinally spaced protrusions on the inner surface of the may engage with a protrusion on the inner portion of the device to locate the housing portion. Preferably the protrusion on the inner portion is sprung such that it can be made to pass the protrusions on the housing on the application of a force. It may be particularly advantageous that the inner surface of the housing has a non-circular cross-sectional shape, for example a polygonal shape. By locating protrusions at corners of the inner surface of the housing it is possible to control the properties of the snaps to optimise their function. A removable housing portion may have a set of snaps that hold the housing portion in a fully closed position adjacent a second housing portion. There may be a second set of snaps that retain the housing portion in a second position that is slideably removed from the first position, but still attached to the device. The relative strength of different sets of snaps may be varied.

Where an external housing comprises two or more separate portions, the visual appearance of the device may be impaired if the two or more portions do not align with precision. For example, if the device is in the form of a cylinder having a polygonal base, any mismatch or misalignment between adjacent housing portions will become immediately apparent when the housing portions are brought together. This may be a result of light reflecting at different angles from substantially flat longitudinal faces defined on the external surface of the housing. If the longitudinal faces are not perfectly flat, however, the visual impairment may not be as noticeable. For example, if the device has a polygonal cross-section, and the faces of the polygon are very slightly outwardly curved, longitudinal faces of the device will have a slight transverse curvature. This slight curvature produces an optical effect that may disguise imperfect alignments between adjacent portions of the housing, which may not be as noticeable as if the faces were perfectly flat. While some curvature may be desirable, it is preferable that any convex curvature is not sufficient to facilitate rolling of the device. Thus, it is preferred that any curve delineating a face in the external cross-section of the device has a radius that is substantially greater than the distance across the face. In this way the device may be simultaneously aesthetically pleasing, have a pleasant ergonomic feel, and have an external shape that provides stability against rolling.

The outer housing of the aerosol-generating system may be manufactured from any suitable material or combination of materials. Examples of suitable materials include, but are not limited to, metallic materials and metals, alloys, polymers and plastics, or composite materials containing one or more of those materials, or thermoplastics that are suitable for food or pharmaceutical applications, for example polypropylene, polyetheretherketone (PEEK) and polyethylene. Preferred materials may include aluminium and aluminium alloys, acrylonitrile butadiene styrene (ABS), and polycarbonate (PC). When a metal, metallic material, or composite material comprising a metal is used, the surface may be anodized or otherwise treated to improve the appearance of and provide a scratch resistance surface for the device housing. Similarly, when the material does not comprise a metal, metallic material, or composite material, materials may be selected to optimize the appearance and functionality, e.g., scratch resistance, of the housing.

In a further aspect, there is also provided an aerosol-generating system. The system comprises an elongate aerosol-generating device as described above, and a charging device comprising a cavity having an opening suitable for receiving the aerosol-generating device.

Preferably, the aerosol-generating device comprises a means for keying the aerosol-generating device to the receiving cavity of the charging device. The keying means may comprise at least one notch for receiving at least one corresponding protrusion on the aerosol-generating device. The at least one protrusion may be a button adapted to activate the aerosol-generating device. Alternatively, the button of the device itself may function as the protrusion that facilitates keying. The aerosol-generating device receiving cavity may have a cross-sectional shape that corresponds to the cross-sectional shape of the aerosol-generating device. The keying means may then result from an enforced orientational relationship between the aerosol-generating device and the receiving cavity.

In one embodiment where the aerosol-generating device comprises at least one tapered end, the tapered end enables the device to be more easily inserted into the cavity of the charging device.

In one further aspect there is provided an aerosol-generating device comprising a heating element and an external housing, in which the external housing is elongate and is adapted to resist rolling.

The housing may, for example, comprise one or more projections or protrusions that impinge on a surface should the device begin to roll. The projections or protrusions effectively stabilise the device against rolling.

The external shape of the housing may act to stabilise the device against rolling. For example, the housing may be elongate and comprise at least one longitudinal edge. An example of a shape that has one longitudinal edge and increases stability against rolling may be a cylinder that has a cross-section in the form of a tear drop.

The external housing may have a transverse cross-section formed by a shape that has at least three corners connected by straight lines or curves. The presence of three corners advantageously stabilises the device against rolling.

An aerosol-generating device may have a transverse external cross-section defined by a shape having at least five sides. It is preferred that the aerosol-generating device has a high aspect ratio and that a substantial proportion of the length has the defined cross-section. The entire length of the device may have the defined transverse cross-section.

The polygon may be a regular polygon. The term regular polygon refers to a polygon that is equiangular, all of the angles are the same, and equilateral, all of the sides are the same length. The sides may be straight or slightly curved. The angles may be formed by sharp corners or rounded corners. The aerosol-generating device may have a regular polygonal transverse cross-section along its entire length. Alternatively, the aerosol-generating device may have a regular polygonal cross-section that extends along only a portion of its length. For example, the cross-section of the aerosol-generating device may change due to the presence of a button. Such a button may be adapted to activate the device in use. The position of the button may be chosen so as to facilitate presentation of the button on an uppermost surface regardless of the shape of the device.

As used herein, the term "length" refers to the dimension in the longitudinal direction. The term "longitudinal" refers to the main axis of the elongate aerosol-generating device. As used herein, the term "transverse" refers to a direction perpendicular to the longitudinal direction.

At least one end of the aerosol-generating device may be tapered. Alternatively, both ends of the aerosol-generating device may be tapered. Preferably, the radius of the or each end face of the tapered end is at least 50% of the maximum radius of the aerosol-generating device. The radius of a polygon is measured from the centroid of the polygon to a vertex thereof.

Where the, or each, end of the aerosol-generating device is tapered, preferably, the, or each, end of the aerosol-generating device is tapered along at least about 5% of the length of the device. More preferably, the, or each, end of the aerosol-generating device is tapered along at least about 7% of the length of the device. Yet more preferably, the, or each, end of the aerosol-generating device is tapered along at least about 7.5%.

Where a housing portion is removable from the device it may be desirable that the housing portion should only be couplable to the device in a specific orientation. The removable housing portion may, for example, slide over a substantially cylindrical inner portion of the device. In such circumstances an inner surface of the housing may define a notch or a protrusion that keys with a corresponding protrusion or notch on the inner portion to ensure that the housing portion may only be coupled to the aerosol-generating device in a specific orientation.

In a further aspect, there is also provided an aerosol-generating system. The system comprises an elongate aerosol-generating device as described above, and a charging device comprising a cavity having an opening suitable for receiving the aerosol-generating device. It may be advantageous that the aerosol-generating device can only be inserted into the cavity in a predetermined orientation.

Preferably, the aerosol-generating device comprises a means for keying the aerosol-generating device to the receiving cavity of the charging device. The keying means may comprise at least one notch for receiving at least one corresponding protrusion on the aerosol-generating device. The at least one protrusion may be a button adapted to activate the aerosol-generating device. Alternatively, the button of the device itself may function as the protrusion that facilitates keying. The aerosol-generating device receiving cavity may have a cross-sectional shape that corresponds to the cross-sectional shape of the aerosol-generating device. The keying means may then result from an enforced orientational relationship between the aerosol-generating device and the receiving cavity.

In one embodiment where the aerosol-generating device comprises at least one tapered end, the tapered end enables the device to be more easily inserted into the cavity of the charging device.

In one further aspect there may be provided an aerosol-generating device or system as defined in the following set of numbered clauses.

1. An aerosol-generating device comprising a heating element and an external housing, in which the external housing is elongate and comprises one or more protrusions extending transversely from the housing.
2. An aerosol-generating device according to clause 1 in which the housing is substantially cylindrical.
3. An aerosol-generating device according to clause 2 in which the cylinder has a cross-section selected from the group consisting of circular, oval, regular polygonal and irregular polygonal.
4. An aerosol-generating device according to clause 2 in which the cylinder has a transverse cross-section defining a shape having three, four, five, six, seven, eight, nine, ten, eleven, twelve, thirteen, fourteen, fifteen, or sixteen corners.
5. An aerosol-generating device according to any preceding clause in which at least one end of the aerosol-generating device is tapered.
6. An aerosol-generating device according to any preceding clause in which the housing is between 80 mm and 150 mm in length, preferably about 93 mm.
7. An aerosol-generating device according to any preceding clause in which the one or more protrusions extend by a distance of more than 1.5 mm.
8. An aerosol-generating device according to any preceding clause in which the one or more protrusions stabilise the device against rolling.
9. An aerosol-generating device according to any preceding clause comprising a cavity for receiving an aerosol-generating article such that an aerosol-forming substrate comprised in the aerosol-generating article is located in proximity to the heating element.
10. An aerosol-generating device according to any preceding clause in which the housing comprises two or more sections.
11. A system comprising an aerosol-generating device according to any preceding clause and a charging device comprising a cavity for receiving the aerosol-generating device, in which the cavity comprises a notch for keying with one or more protrusions on the housing to orient the aerosol-generating device within the cavity.

In one further aspect there may be provided an aerosol-generating device or system as defined in the following set of numbered clauses.

1. An aerosol-generating device comprising a heating element and an external housing, in which the external housing is elongate and has a transverse cross-section forming a shape having at least three corners connected by straight lines or curves.
2. An aerosol-generating device according to clause 1 in which the external housing is substantially cylindrical.
3. An aerosol-generating device according to clause 2 in which the cylinder has a cross-section defining a shape having three, four, five, six, seven, eight, nine, ten, eleven, twelve, thirteen, fourteen, fifteen, or sixteen corners.
4. An aerosol-generating device according to any preceding clause in which corners are spaced by between 2 mm and 10 mm and are connected by curves having a radius of curvature of between 100 mm and 10000 mm, preferably between 200 mm and 2000 mm.
5. An aerosol-generating device according to any preceding clause in which at least one end of the aerosol-generating device is tapered.
6. An aerosol-generating device according to any preceding clause in which the housing is between 80 mm and 150 mm in length, preferably about 93 mm.
7. An aerosol-generating device according to any preceding clause in which the transverse cross-sectional shape stabilises the device against rolling.
8. An aerosol-generating device according to any preceding clause comprising a cavity for receiving an aerosol-generating article such that an aerosol-forming substrate comprised in the aerosol-generating article is located in proximity to the heating element.
9. An aerosol-generating device according to any preceding clause in which the housing comprises two or more sections.
10. A system comprising an aerosol-generating device according to any preceding clause and a charging device comprising a cavity for receiving the aerosol-generating device, in which the cavity is shaped to receive the aerosol-generating device within the cavity.

In one further aspect there may be provided an aerosol-generating device or system as defined in the following set of numbered clauses.

1. An elongate aerosol-generating device comprising a heating element and comprising at least one longitudinal edge.
2. An aerosol-generating device according to clause 1 comprising 2 longitudinal edges.
3. An aerosol-generating device according to clause 1 or 2 comprising three or more edges, in which a transverse cross-section of at least one location along the aerosol-generating device defines a shape having corners connected by straight lines or curves.
4. An aerosol-generating article according to clause 3 in which the corners are connected by curves, the curves having a radius larger than a radius of a circumcircle of the shape.
5. An aerosol-generating device according to any preceding clause in which the housing comprises two or more sections.
6. An aerosol-generating device according to any preceding clause in which the at least one longitudinal edge stabilises the device against rolling.
7. An aerosol-generating device according to any preceding clause comprising a cavity for receiving an aerosol-generating article such that an aerosol-forming substrate comprised in the aerosol-generating article is located in proximity to the heating element.
8. A system comprising an aerosol-generating device according to any preceding clause and a charging device comprising a cavity for receiving the aerosol-generating device, in which the cavity is shaped to receive the aerosol-generating device within the cavity.
9. A system according to clause 8, in which the cavity comprises a notch for keying with the at least one longitudinal edge on the housing to orient the aerosol-generating device within the cavity.

In one further aspect there may be provided an aerosol-generating device or system as defined in the following set of numbered clauses.

1. An aerosol-generating device comprising a heating element and an elongate housing comprising a manually-actuatable button for actuating the heating element.
2. An aerosol-generating device according to clause 1 in which the button projects transversely from the housing by at least 1 mm.
3. An aerosol-generating device according to clause 1 in which the housing defines a raised protrusion adjacent the button.
4. An aerosol-generating device according to clause 1 in which the button is surrounded by a raised ridge or protrusion extending transversely from the housing.
5. An aerosol-generating device according to any preceding clause in which the button comprises a recess for locating a users thumb or finger.
6. An aerosol-generating device according to any preceding clause in which the button is formed from a transparent material and the device further comprises an indicator light within the housing that is visible through the button when the device is actuated.
7. An aerosol-generating device according to any of clauses 1 to 5 comprising an indicator light within the housing that lights when the device is actuated, in which the button comprises a transparent portion that acts as a light guide so that the indicator light is visible to a user.
8. An aerosol-generating device according to any preceding clause in which at least one end of the aerosol-generating device is tapered.
9. An aerosol-generating device according to any preceding clause in which the housing is between 80 mm and 150 mm in length, preferably about 93 mm.
10. An aerosol-generating device according to any preceding clause in which the button or a protrusion from the housing immediately adjacent the button, stabilises the device against rolling.
11. An aerosol-generating device according to any preceding clause comprising a cavity for receiving an aerosol-generating article such that an aerosol-forming substrate comprised in the aerosol-generating article is located in proximity to the heating element.
12. An aerosol-generating device according to any preceding clause in which the housing comprises two or more sections.
13. A system comprising an aerosol-generating device according to any preceding clause and a charging device comprising a cavity for receiving the aerosol-generating device, in which the cavity comprises a notch for keying with the button or a protrusion from the housing adjacent the button on the housing to orient the aerosol-generating device within the cavity.

In one aspect there may be provided an aerosol-generating device or system as defined in the following set of numbered clauses.

1. An aerosol-generating device comprising a heating element and an elongate housing having a first end face and a second end face and at least one longitudinal face, in which a cavity is defined in the first end face for receiving an aerosol-generating article such that an aerosol-forming substrate comprised in the aerosol-generating article is located in proximity to the heating element, and at least one electrical contact is defined in the second end face.
2. An aerosol-generating device according to clause 1 in which at least two electrical contacts are defined in the second end face.
3. An aerosol-generating device according to clause 1 or 2 comprising 4 or 5 or 6 or 7 electrical contacts defined in the second end face.
4. An aerosol-generating device according to any preceding clause comprising a battery for powering the heating element, in which the at least one electrical contact is used to recharge the battery.
5. An aerosol-generating device according to any preceding clause in which at least one end of the aerosol-generating device is tapered.
6. An aerosol-generating device according to any preceding clause in which the housing is between 80 mm and 150 mm in length, preferably about 93 mm.
7. An aerosol-generating device according to any preceding clause in which the housing comprises two or more sections.
8. A system comprising an aerosol-generating device according to any preceding clause and a charging device comprising a cavity for receiving the aerosol-generating device, in which the cavity terminates in at least one electrical contact for electrically coupling to the at least one electrical contact defined in the second end face.

In one aspect there may be provided an aerosol-generating device or system as defined in the following set of numbered clauses.

1. An aerosol-generating device comprising a heating element and an elongate housing, in which the housing comprises two portions, a first portion of the housing being slidable removable from the device, in which the housing is formed from a metal having a wall thickness of between 0.2 and 0.75 mm.
2. An aerosol-generating device according to clause 1 in which the metal is aluminium or an aluminium alloy.
3. An aerosol-generating device according to clause 1 or 2 in which an internal surface of the first portion of the housing slides against a sliding surface of the device, at least one of the two sliding surfaces being hardened.

In one aspect there may be provided an aerosol-generating device or system as defined in the following set of numbered clauses.

1. An aerosol-generating device comprising an elongate housing formed from a polymeric material having a wall thickness of between 0.5 mm and 1 mm.
2. An aerosol-generating device according to clause 1 in which the wall thickness is between 0.6 mm and 0.8 mm, preferably about 0.75 mm.
3. An aerosol-generating device according to clause 1 in which the housing has a total length of between 80 mm and 100 mm, preferably about 90 mm to 95 mm, for example 93 mm.
4. An aerosol-generating device according to any preceding clause in which the housing is formed from acrylonitrile butadiene styrene (ABS) or polycarbonate (PC).
5. An aerosol-generating device according to any preceding clause in which the housing is formed from two portions, a first portion being removable from the device.

Features disclosed in different aspects of the invention disclosed above may be combined.

In one yet further aspect there is provided an elongate aerosol-generating device in which at least a portion of the device has a transverse external cross-section defined by a shape having at least five sides. It is preferred that the aerosol-generating device has a high aspect ratio and that a substantial proportion of the length has the defined cross-section. The entire length of the device may have the defined transverse cross-section.

In a further aspect, there is also provided an aerosol-generating system. The system comprises an elongate aerosol-generating device as described above, and a charging device comprising a cavity having an opening suitable for receiving the aerosol-generating device.

Preferably, the aerosol-generating device comprises a means for keying the aerosol-generating device to the receiving cavity of the charging device. The keying means may comprise at least one notch for receiving at least one corresponding protrusion on the aerosol-generating device. The at least one protrusion may be a button adapted to activate the aerosol-generating device. Alternatively, the button of the device itself may function as the protrusion that facilitates keying. The aerosol-generating device receiving cavity may have a cross-sectional shape that corresponds to the cross-sectional shape of the aerosol-generating device. The keying means may then result from an enforced orientational relationship between the aerosol-generating device and the receiving cavity.

In one embodiment where the aerosol-generating device comprises at least one tapered end, the tapered end enables the device to be more easily inserted into the cavity of the charging device.

In one yet further aspect there is provided an aerosol-generating device comprising a heating element and a rechargeable power source. The device comprises a coupling portion for coupling the aerosol-generating device to a charging device for recharging the power source. The coupling portion is stepped or tapered. Coupling portion refers to a portion of the device that is inserted into a receiving portion of a charging device.

As used herein, 'tapered' refers a progressive reduction in cross-sectional area of a portion of a device. For example, a device may be substantially cylindrical in shape, having first and second ends. One of the ends may be tapered at its terminal end. This means that the transverse cross-section is progressively reduced as the cross-section approaches the terminal end.

As used herein, 'stepped' refers to a staged reduction in cross-sectional area of a portion of a device. For example, a device may be substantially cylindrical in shape, having first and second ends. One of the ends may be stepped at its terminal end. This means that the transverse cross-section is reduced in one or more discrete stages as the cross-section approaches the terminal end.

Preferably, at least one contact is located on or at the coupling portion. It may be advantageous for the coupling portion to comprise more contacts, for example 2 or 3 or 4 or 5 contacts. The coupling portion may comprise more than 5 contacts. Contacts may be electrical contacts, for example contacts for recharging the rechargeable power supply. Contacts may be contacts for data transfer. The coupling portion may comprise a combination of electrical and data contacts.

The aerosol-generating device may be an elongate aerosol-generating device having a first end and a second end. For example, the aerosol-generating device may have an external shape defined by an elongate housing having a first end and a second end. The coupling portion may be defined by a portion of the device or housing that extends towards and includes either the first end or the second end.

The device may comprise two coupling portions. If so, a first coupling portion may comprise the first end of the device and a second coupling portion may comprise the second end of the device.

It may be important to correctly align the coupling portion for engagement with the charging device. The coupling portion may, therefore, comprise means for alignment with the charging device. The means for alignment may relate to a cross-sectional shape of the device. For example, the cross-sectional shape of the device may form a mating engagement with a receiving channel or sheath defined in the charging device. The means for alignment may relate to a keying function, for example the coupling portion may include one or more projections for engagement with an associated slot on a charging device to align the coupling portion with the charging device. The coupling portion may comprise one or more slots for engagement with associated projections on the charging unit to align the coupling portion with the charging unit.

An elongate aerosol-generating device may have a transverse external cross-section defined by a shape having at least five sides. It is preferred that the aerosol-generating device has a high aspect ratio and that a substantial proportion of the length has the defined cross-section. The entire length of the device may have the defined transverse cross-section.

The external cross-section of the coupling portion may be a polygonal transverse cross-section. The external cross-section of the device may be a polygonal transverse cross-section. Discussion of cross-section below may relate to either the cross-section of the device or the cross-section of the coupling portion. In preferred embodiments the cross-section of the device and the cross-section of the coupling portion are the same. Polygonal cross-sections may be defined by shapes having three or more sides. The polygon may comprise at least five or six sides.

The device may be greater than 60 mm in length. The device may be less than 150 mm in length. For example, the device may be between 80 mm and 120 mm in length. The device may be between 90 mm and 110 mm in length.

At least one end of the aerosol-generating device may be tapered or stepped, for example, one end of the device may form the coupling portion. Alternatively, both ends of the aerosol-generating device may be tapered. Preferably, the radius of the, or each, end face of the tapered end is at least 50% of the maximum radius of the aerosol-generating device. The radius of a polygon is measured from the centroid of the polygon to a vertex thereof.

Where the, or each, end of the aerosol-generating device is tapered or stepped, preferably, the, or each, end of the aerosol-generating device is tapered or stepped along at least about 5% of the length of the device. More preferably, the, or each, end of the aerosol-generating device is tapered or stepped along at least about 7% of the length of the device. Yet more preferably, the, or each, end of the aerosol-generating device is tapered or stepped along at least about 7.5%. Each end of the device may be tapered or stepped along up to 20% of the length of the device.

The taper or step may be symmetrical around a central longitudinal axis of the coupling portion or device. For example, a taper may have a symmetrical longitudinal cross-section with the terminal point of the taper lying along the central longitudinal axis of the coupling portion or device.

Where the, or each, end of the aerosol-generating device is tapered, the taper may be linear or curved. The presence of a taper or step may be particularly advantageous where one end of the device is configured to be inserted into and couple with another device. For example, one or more contacts may be located at or near a first end of the device such that they can be brought into contact with contacts located within a receiving cavity of another device. A tapered end of the device, in conjunction with a mating receiving portion, allows the device to be coupled swiftly and easily by a user. The taper guides the device into a correct position within the receiving cavity. Due to the guiding effect provided by the taper, it is possible for a user to couple the device to another device, for example a charging unit, without looking at the device to align the contacts. This may be advantageous as the act of coupling the device to another device can be carried out in the dark or while a user is engaged in conversation.

In a further aspect, there is also provided an aerosol-generating system. The system comprises an aerosol-generating device as described above, and a charging device comprising a receiving portion for receiving the coupling portion of the device. A first contact is located on the coupling portion of the device. A second contact is located on the receiving portion of the charging device. Preferably, the receiving portion comprises a cavity having an opening suitable for receiving the coupling portion of the aerosol-generating device.

The charging device may itself be a portable device, and may comprise a rechargeable power source for recharging the rechargeable power source of the aerosol-generating device.

The system may advantageously comprise more than one aerosol-generating device. Thus, it may be possible to charge one device while using another. It may be possible to have different devices specified for different aerosol-generating articles. It may be possible to have spare aerosol-generating devices for sharing with friends.

Preferably, the aerosol-generating device comprises a means for keying the aerosol-generating device to the receiving cavity of the charging device. The keying means may comprise at least one notch for receiving at least one corresponding protrusion on the aerosol-generating device. The at least one protrusion may be a button adapted to activate the aerosol-generating device. Alternatively, the button of the device itself may function as the protrusion that facilitates keying. The aerosol-generating device receiving cavity may have a cross-sectional shape that corresponds to the cross-sectional shape of the aerosol-generating device. The keying means may then result from an enforced orientational relationship between the aerosol-generating device and the receiving cavity.

In one embodiment where the aerosol-generating device comprises at least one tapered end, the tapered end enables the device to be more easily inserted into the cavity of the charging device.

As used herein, means plus function features may be expressed alternatively in terms of their corresponding structure.

Any feature relating to one aspect may be applied to other aspects, in any appropriate combination. In particular, method aspects may be applied to apparatus aspects, and vice versa. Furthermore, any, some or all features in one aspect can be applied to any, some or all features in any other aspect, in any appropriate combination.

It should also be appreciated that particular combinations of the various features described and defined in any aspects of the invention can be implemented or supplied or used independently.

These and other aspects of the apparatus will become apparent from the following exemplary embodiments that are described with reference to the following figures in which.

Figure 1:
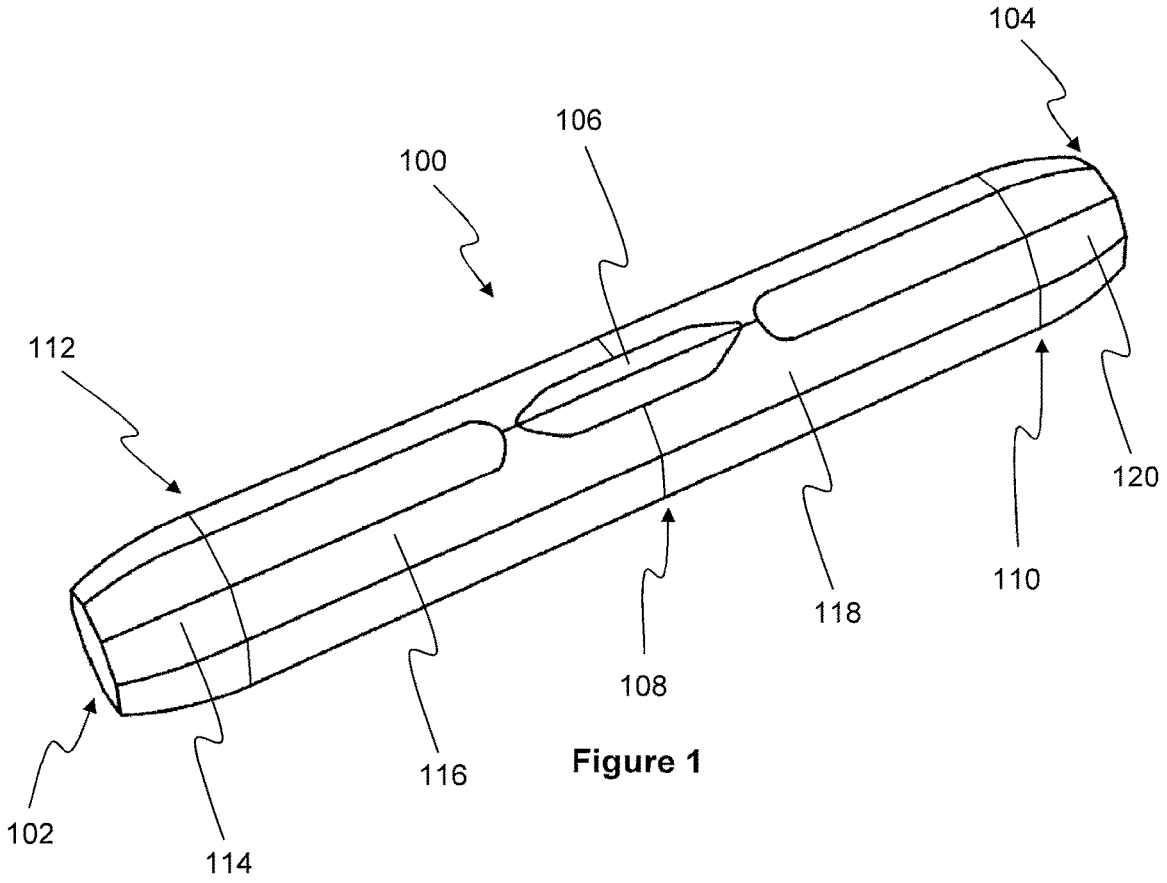
FIG. 1 shows a perspective view of one embodiment of an aerosol-generating device.
Figure 2:
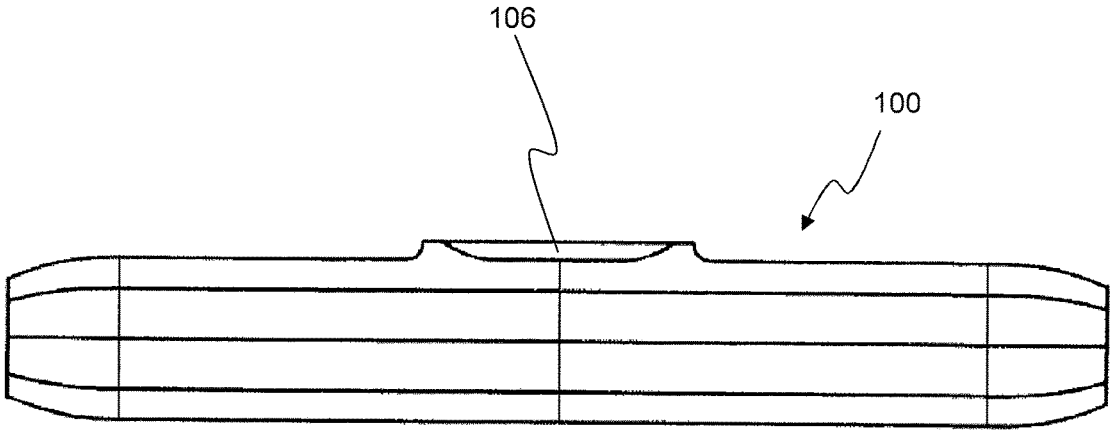
FIG. 2 shows a side-view of the aerosol-generating device shown in FIG. 1.
Figure 3B:
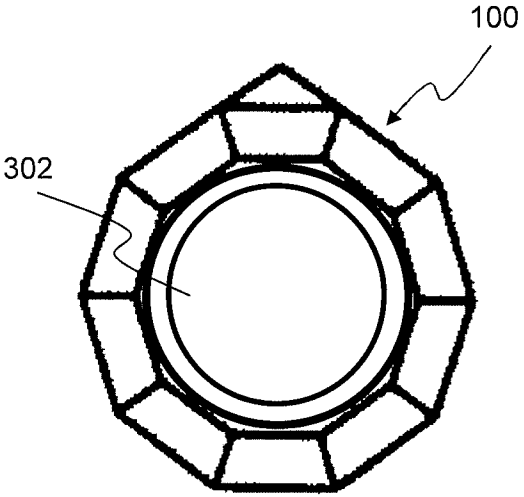
Figure 3C:
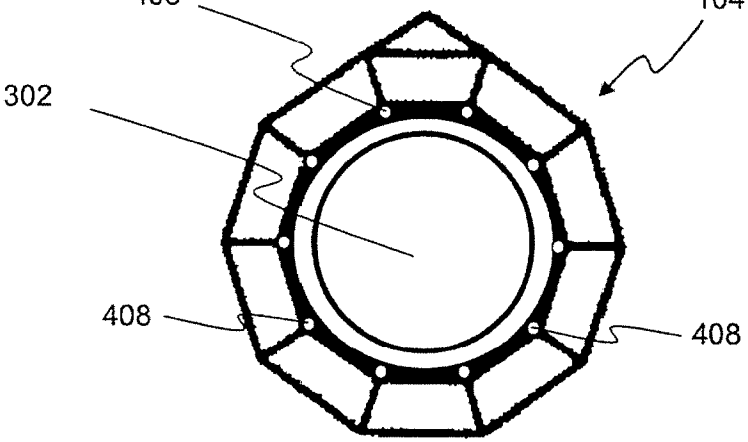
Figure 3A:
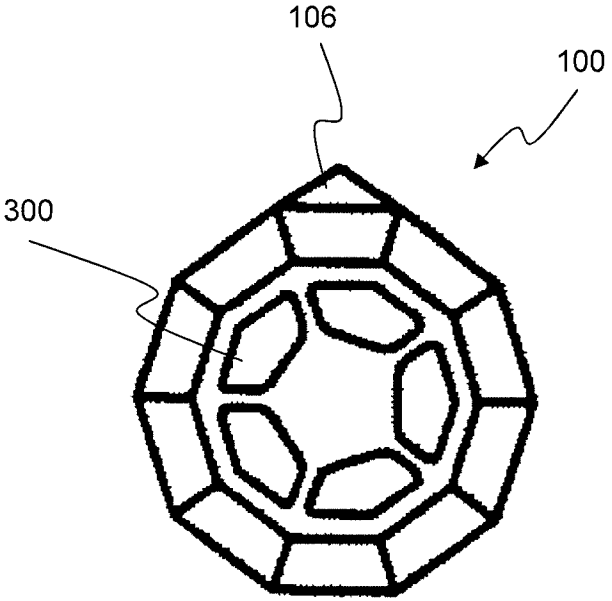
Figure 4A:
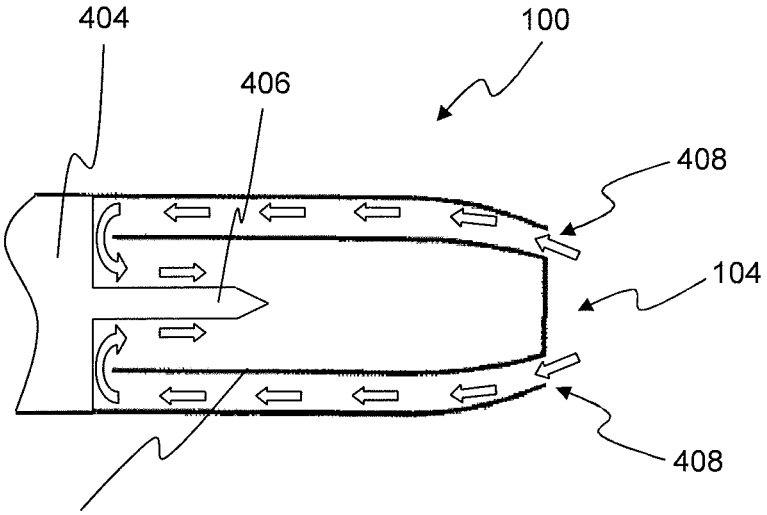
Figure 4B:
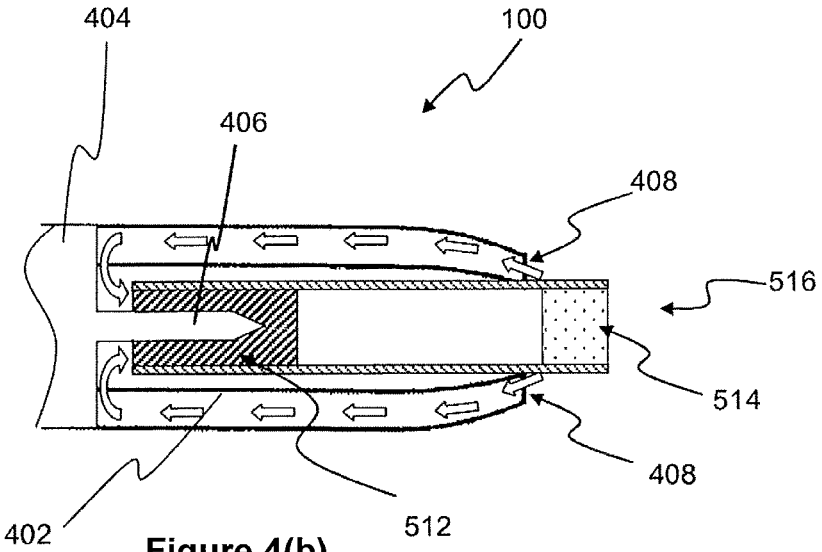
Figure 5:
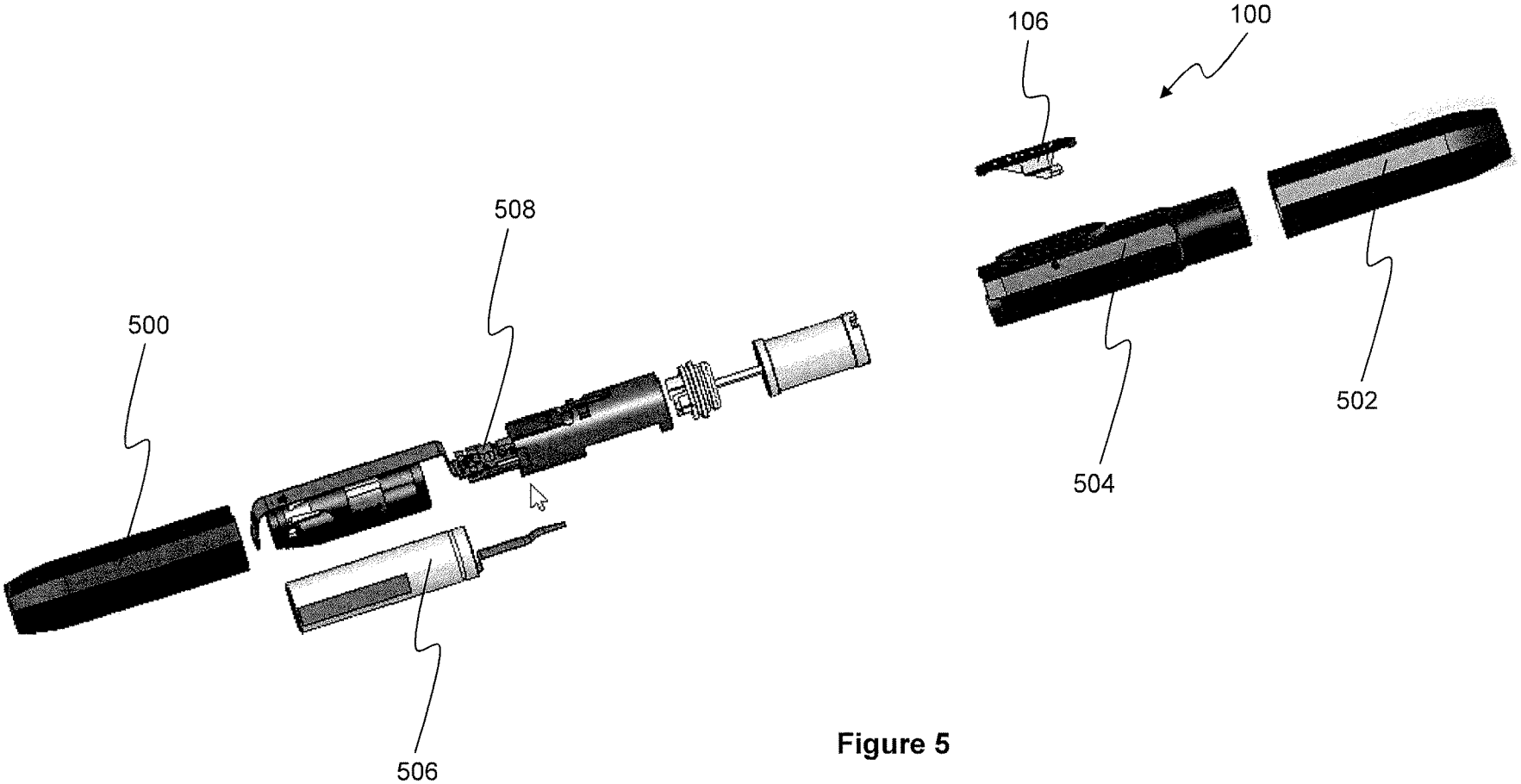
Figure 6A:
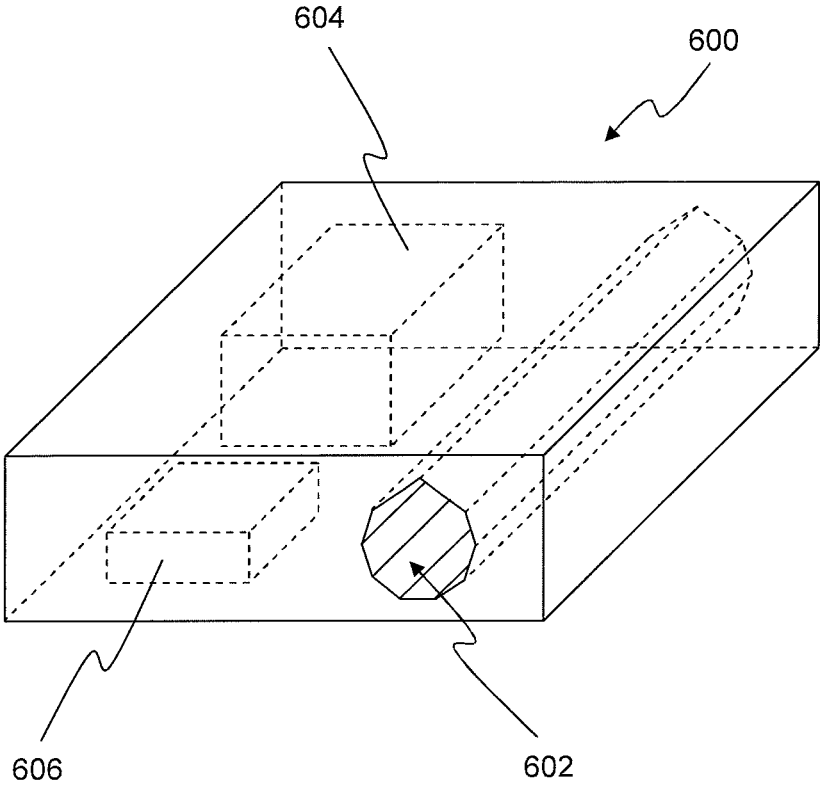
Figure 6B:
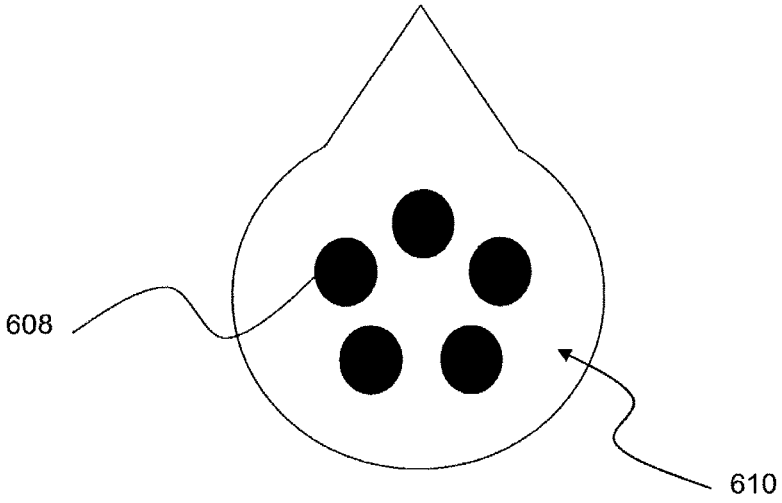
Figure 7A:
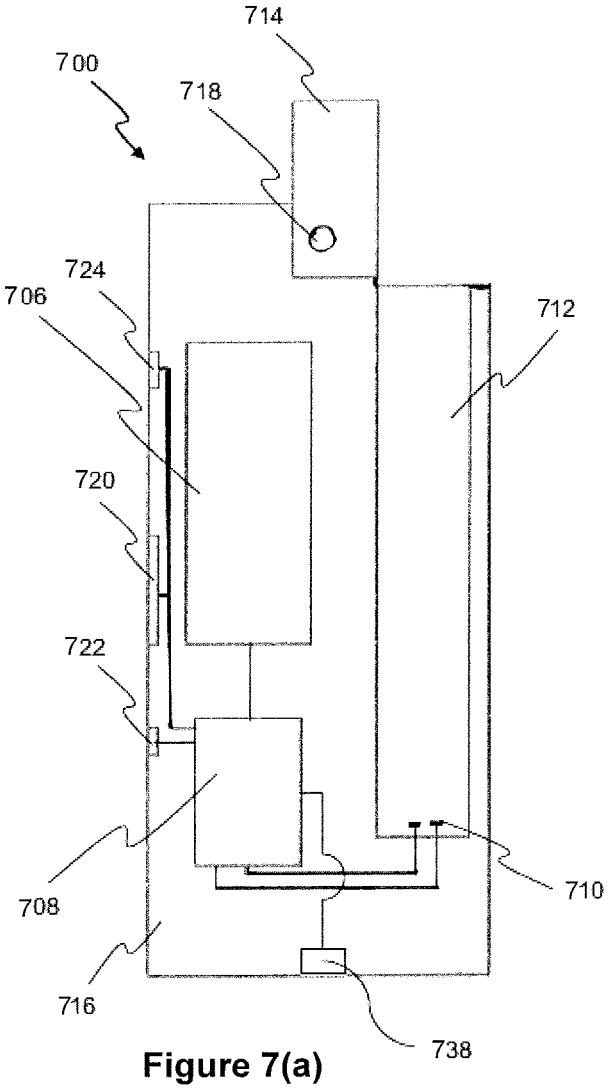
Figure 7B:
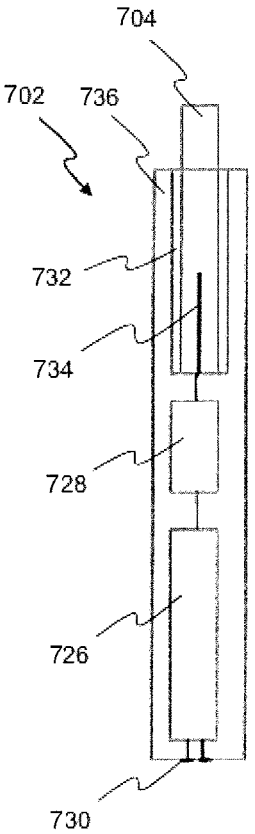
Figure 8:
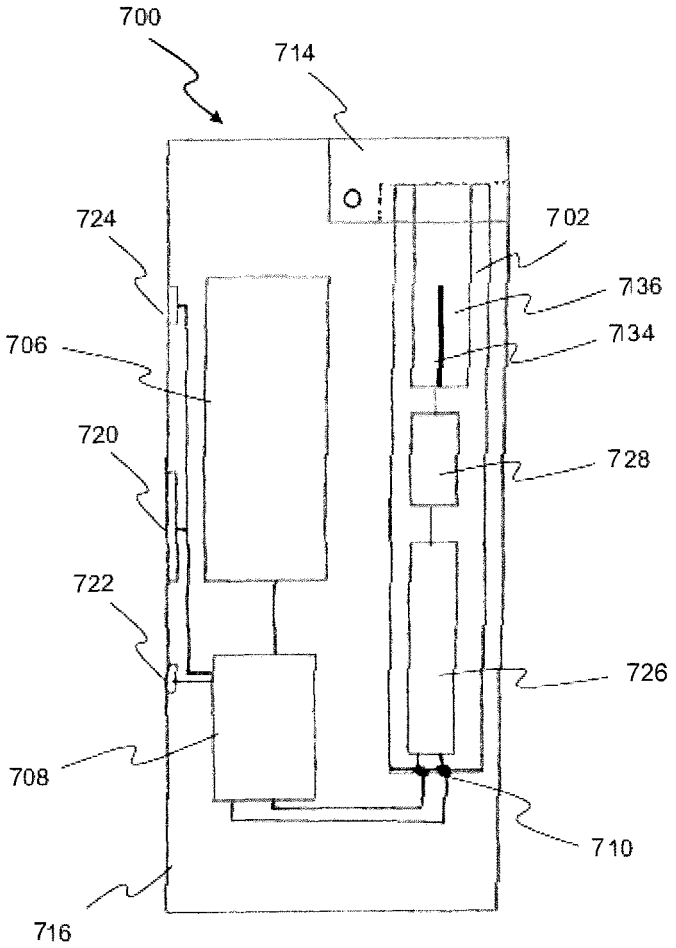
Figure 9:
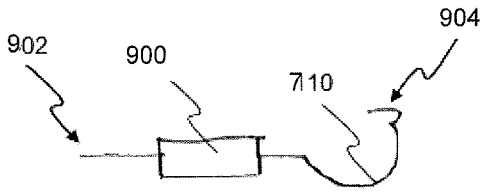
Figure 10:
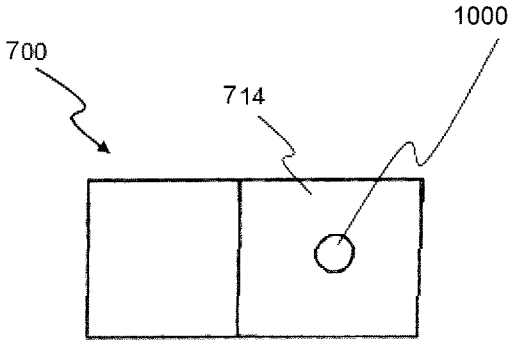
Figure 11A:
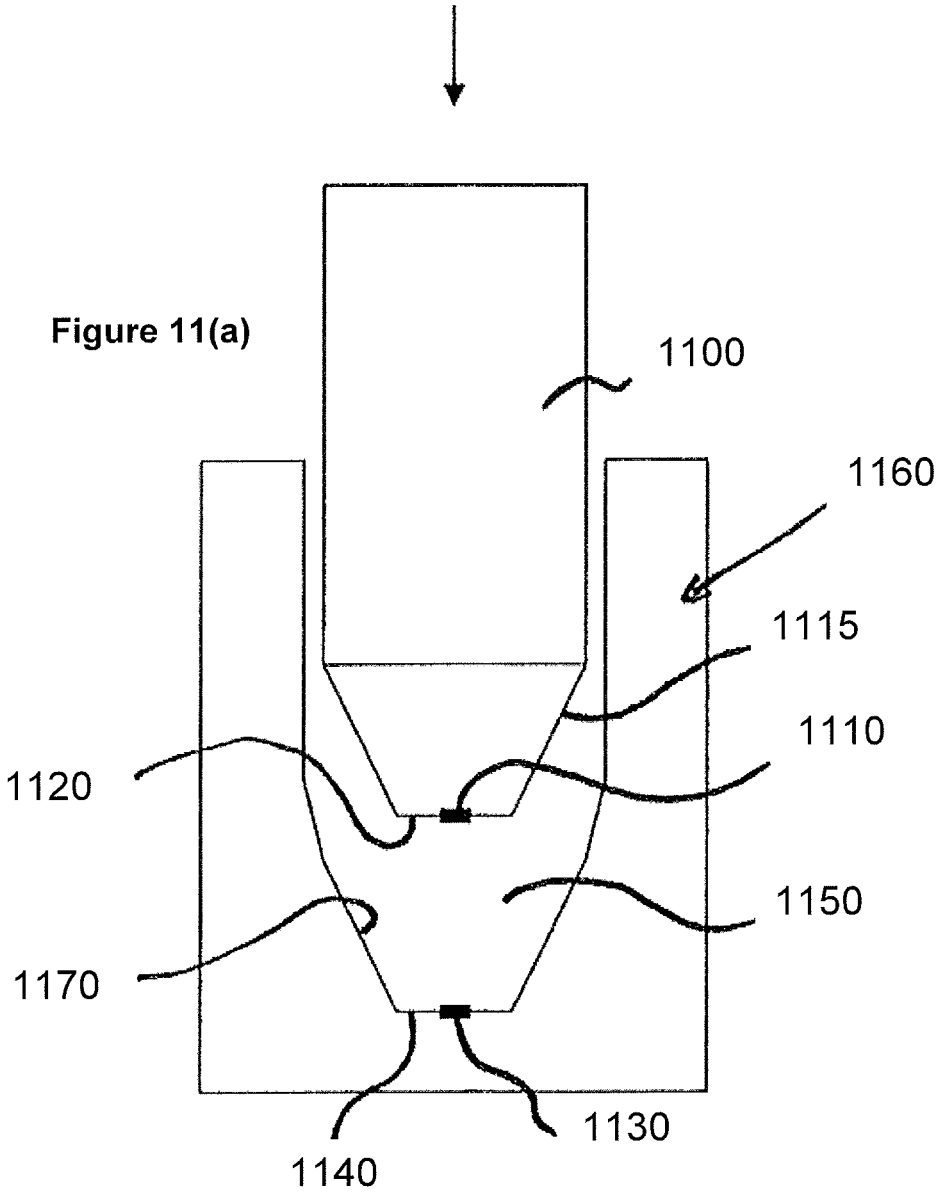
Figure 11B:
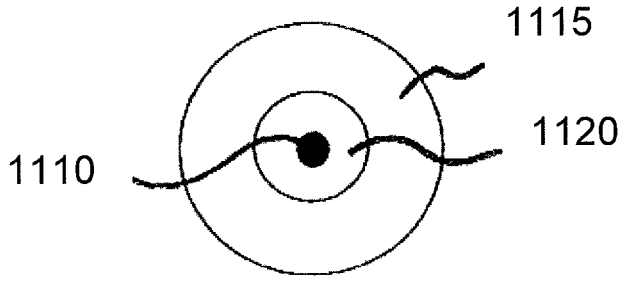
Figure 12A:
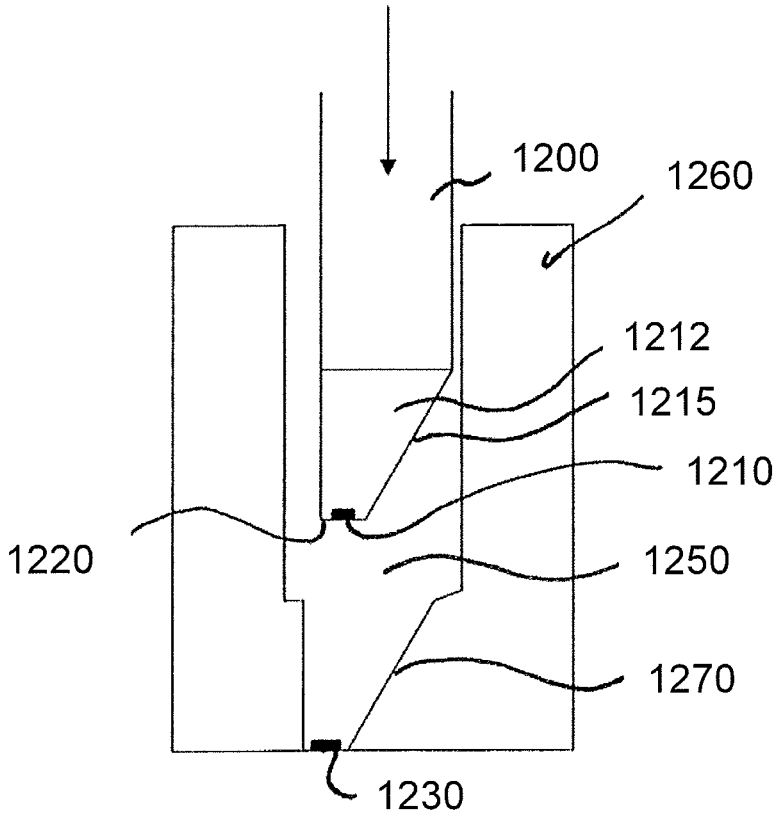
Figure 12B:
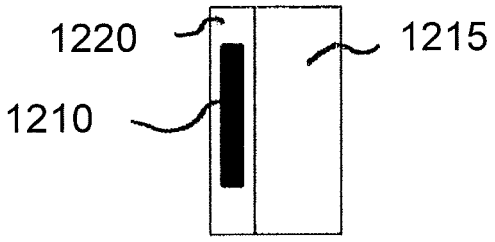
Figure 13A:
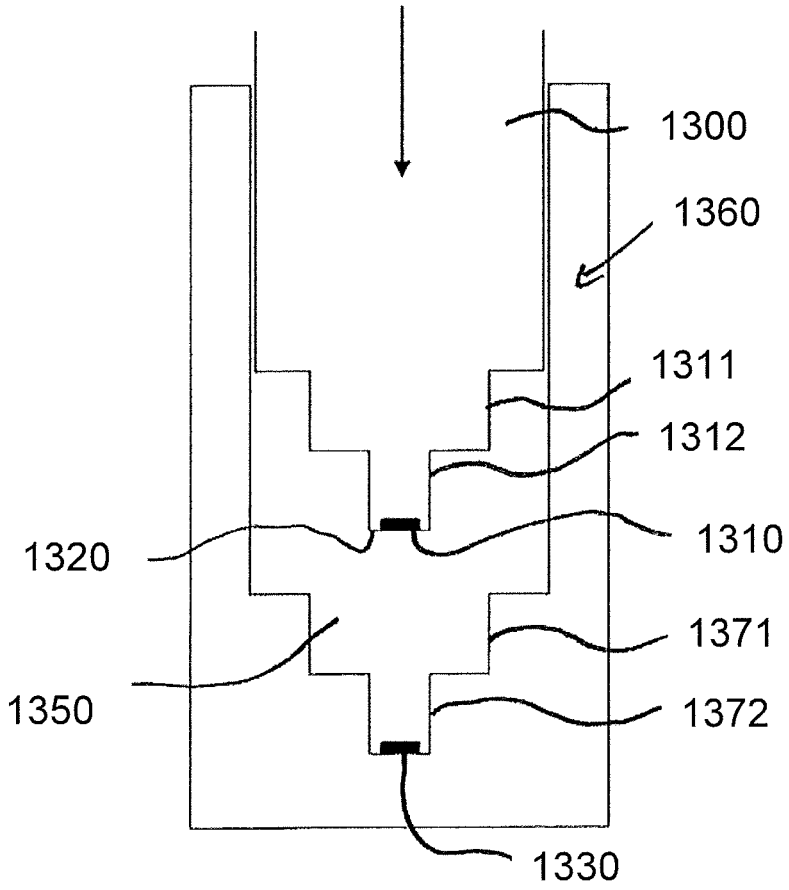
Figure 13B:
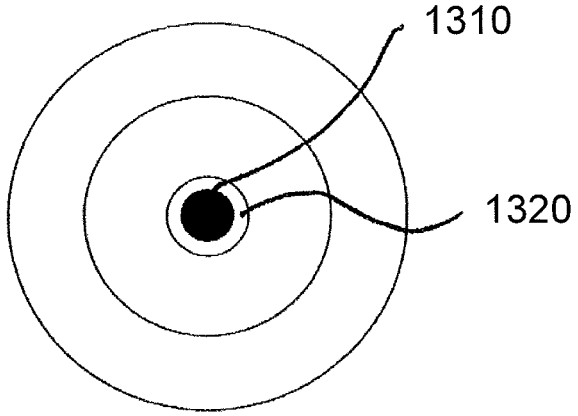
Figure 16:
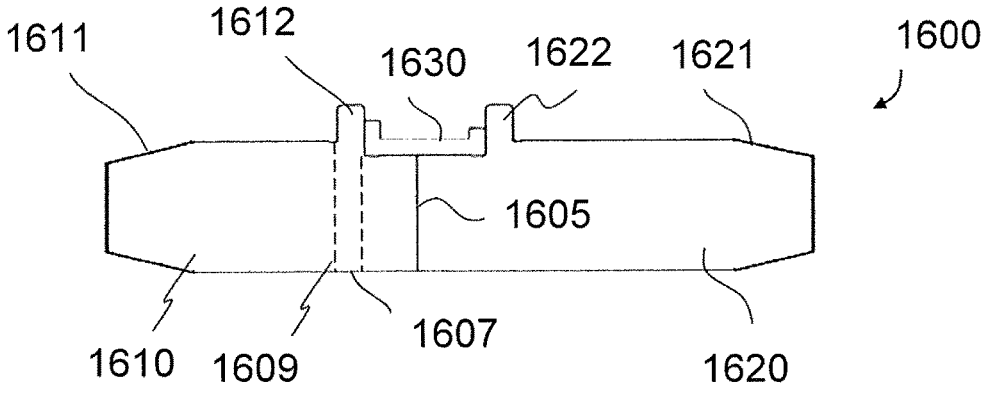
Figure 17:
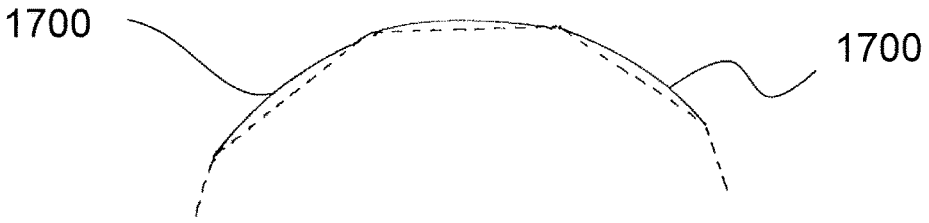
Figure 18:
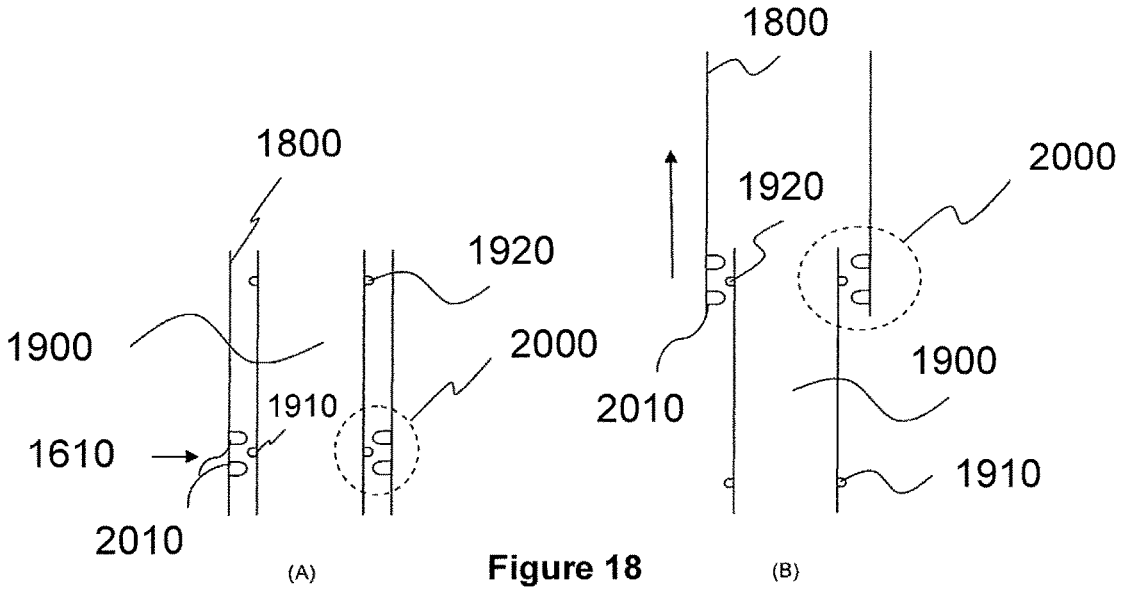
Figure 19:
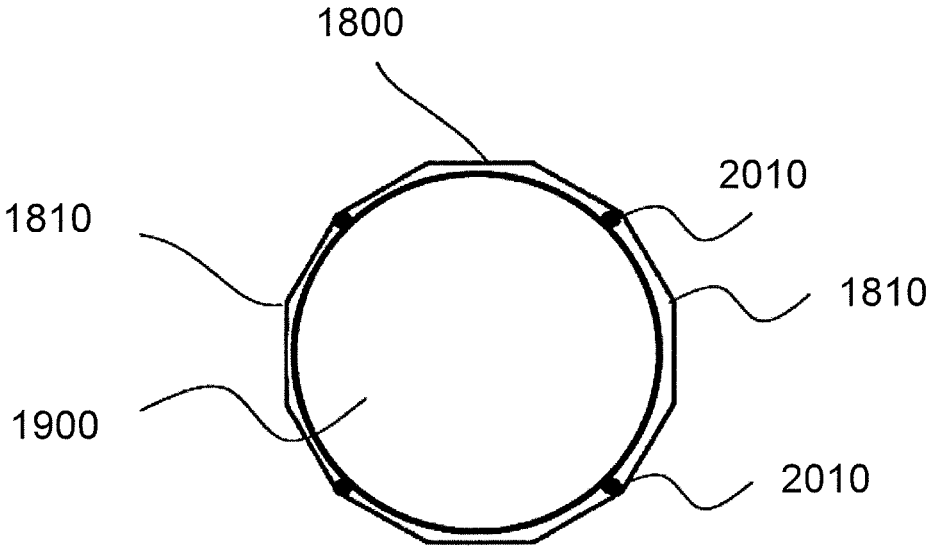

FIGS. 3(*a*), 3(*b*) and 3(*c*) show end-views of the aerosol-generating device shown in FIGS. 1 and 2;

FIGS. 4(*a*) and 4(*b*) illustrate a schematic diagram of the air flow through the aerosol-generating device shown in FIGS. 1, 2 and 3;

FIG. 5 shows an exploded view of the aerosol-generating device shown in FIGS. 1, 2 and 3;

FIGS. 6(*a*) and 6(*b*) illustrate a charging device adapted to receive and charge the aerosol-generating device shown in FIGS. 1 to 5;

FIGS. 7(*a*) and 7(*b*) show a primary device and a secondary device respectively of an electrical system;

FIG. 8 shows the secondary device of FIG. 7(*b*) housed within the primary device of FIG. 7(*a*);

FIG. 9 shows a detail view of an electrical contact of the primary unit shown in FIGS. 7(*a*), and 8;

FIG. 10 shows a top view of the primary device;

FIGS. 11(*a*) and 11(*b*) are a schematic illustration showing a tapered aerosol-generating device being inserted into a cavity of a charging device to make an electrical connection between contacts located on the aerosol-generating device and the charging device respectively;

FIGS. 12(*a*) and 12(*b*) are a schematic illustration showing a further tapered aerosol-generating device being inserted into a cavity of a charging device to make an electrical connection between contacts located on the aerosol-generating device and the charging device respectively;

FIGS. 13(*a*) and 13(*b*) are a schematic illustration showing a further tapered aerosol-generating device being inserted into a cavity of a charging device to make an electrical connection between contacts located on the aerosol-generating device and the charging device respectively;

FIGS. 14(*a*) and 14(*b*) are a schematic illustration showing a further tapered aerosol-generating device being inserted into a cavity of a charging device to make an electrical connection between contacts located on the aerosol-generating device and the charging device respectively;

FIGS. 15A to 15F illustrate exemplary device cross-sections that may provide anti-rolling functionality;

FIG. 16 shows a schematic side view of one embodiment of an aerosol-generating device;

FIG. 17 illustrates the convex decagonal external transverse cross-section of the device of FIG. 17;

FIGS. 18A and 18B are schematic diagrams illustrating the use of snaps defined on an internal surface of a housing portion to retain the housing portion on the device; and FIG. 19 is a schematic cross-sectional illustration of an inner surface of a housing portion showing the circumferential location of snaps illustrated in FIGS. 18A and B.

FIG. 1 shows a perspective view of one embodiment of an aerosol-generating device 100. The device 100 is elongate and comprises two opposed polygonal end faces 102 and 104 respectively. The device 100 also comprises a button 106 adapted to activate the aerosol-generating device when pressed. The operation of the device is described in further detail below. As can be seen, the outer housing of the device 100 comprises four portions joined at the coupling lines 108, 110 and 112 respectively. The outer housing is formed from an aluminium alloy having a wall thickness of approximately 0.3 mm. The four portions respectively are a first tapered end portion 114 attached to a first central portion 116, a second tapered end portion 120 attached to a second central portion 118. The four portions fit together around an inner housing (not shown) in a manner described below.

The device 100 has a regular polygonal cross-section along the majority of its length. However, in the region of the button 106 the cross-section is no longer a regular polygon, but remains a simple polygon.

FIG. 2 shows a side-view of the aerosol-generating device 100 shown in FIG. 1. As can be seen, the button 106 protrudes from the surface of the device so that the user may more easily push the button to activate the device in use.

FIGS. 3(*a*), 3(*b*) and 3(*c*) show the polygonal end faces 102 (FIG. 3(*a*)) and 104 (FIGS. 3(*b*) and 3(*c*)) of the device 100 respectively. As can be seen, the polygon in this embodiment has ten sides, and this results in a device having ten longitudinally extending faces. The button 106 has a triangular cross-section and protrudes from one of the faces of the housing. This means that there is a flat face on the opposite side of the device to the button and the device may, therefore, be rested with the button 106 uppermost. It is noted that if the device were to have a cross-section defined by a polygon with an odd number of sides, it may be preferable for the button to be defined between faces such that it can be uppermost when the device is laying on a surface.

FIG. 3(*a*) shows the end face 102 of the coupling portion with five connectors or contacts 300. Connectors 300 may include one or more electrical connectors or one or more data connectors or a combination of electrical connectors and data connectors. The end face is part of an internal component of the device that is retained within the housing. The electrical connectors are adapted to connect with a secondary, charging, device which is described in further detail below. As can be seen, providing a polygonal cross-section allows for the five electrical connectors 300 to more easily be positioned on the end face 102 of the aerosol-generating device 100.

FIGS. 3(*b*) and 3(*c*) are alternative schematic illustrations of the end face 104. The following description relates primarily to FIG. 3(*c*).

FIG. 3(*c*) shows the end face 104. A holder 402 defining a cavity 302 is provided to accept an aerosol-generating article comprising an aerosol-generating substrate (not shown). As can be seen, the polygon in this embodiment has ten sides, and this results in a device having ten longitudinally extending faces. The button 106 has a triangular cross-section and protrudes from one of the faces of the housing. This means that there is a flat face on the opposite side of the device to the button and the device may, therefore, be rested with the button 106 uppermost. It is noted that if the device were to have a cross-section defined by a polygon with an odd number of sides, it may be preferable for the button to be defined between faces such that it can be uppermost when the device is laying on a surface.

FIGS. 4(*a*) and 4(*b*) show a schematic representation of the air flow through the device. It is noted that these figures do not accurately depict the relative scale of elements of the device, for example the inlet channels. As can be seen in this embodiment, when an aerosol-generating article 516 is received within the cavity 302 of the device 100 (FIG. 4(*b*)), air drawn into the device passes around the outside of a aerosol-generating article holder 402 located within cavity 302. The holder 402 has a circular cross-section. The drawn air proceeds into the aerosol-generating substrate at the distal end of the smoking article adjacent a heating bushing 404 of a blade shaped heating element 406 provided in the cavity 302. The drawn air proceeds through the substrate, entraining the aerosol, and then to the mouth end of the smoking article. Air inlets 408 formed between the outer housing and the holder 402 enable air to be entrained more efficiently and aid with insulating the heated aerosol-generating article from the outer housing. The air inlets 408 may be seen schematically in FIG. 3(*c*). It is noted that the inlets may not be circular, but they are depicted as circular in FIG. 3(*c*) for clarity.

FIG. 5 shows an exploded view of the aerosol-generating device 100. The device comprises a first outer housing portion 500 comprising the first tapered end portion 114 and the first central portion 116. The device further comprises a second outer housing portion 502 comprising the second tapered end portion 120 and the second central portion 118. The device also comprises an inner housing 504. The device also comprises a power supply in the form of a battery 506, a controller 508 adapted to control the power supplied from the battery 506 to a heating element (not shown) contained in an internal housing section 510. The button 106 is located in the central housing portion 504, and engages with the controller 508 to enable the user to activate the device.

In use, a user inserts an aerosol-generating article 516 comprising an aerosol-generating substrate 512 into the cavity 302 of the aerosol-generating device 100. The aerosol-generating substrate 512 engages with the heating element 406. When the user activates the device by pushing button 106, power is supplied to the heating element 406 from the battery 506 via the controller 508. The heating element 406 heats the aerosol-generating substrate 512 to generate an aerosol and the aerosol is entrained within the air flow as the user draws on the mouth end 514 of the aerosol-generating article 516.

FIG. 6(*a*) shows a perspective view of a charging device 600 adapted to receive and charge the aerosol-generating device 100. The charging device comprises a cavity 602 adapted to receive the aerosol-generating device 100, a power supply in the form of a battery 604, and a controller 606. When the device 100 requires charging or data is to be communicated between the devices 100 and 600, device 100 is inserted into the cavity 602, and the connections 300 are coupled to corresponding contacts 608 of contact plate 610 at the bottom of the cavity 602. FIG. 6(*b*) is a schematic diagram illustrating the contact plate 610 of the charging device, which is located at the bottom of the cavity 602. The contact plate can be seen to have five contacts 608, which correspond to the five contacts 300 on the aerosol-generating device.

The cavity 602 has a polygonal cross-section that corresponds to the cross-section of the aerosol-generating device 100. The cavity could, alternatively, have a substantially circular cross-section of diameter sufficient to receive the device. In addition, the cavity is provided with a notch 612 that allows the button 106 of the device to be located within the cavity 602. Button 106 on the device 100 allows the device to be keyed to the charging device 600 such that the device 100 may only be inserted into the charging device 600 in one orientation. By providing such a keying means, the user is prevented from inserting the device 100 incorrectly, and thus the correct connections 300 of device 100 and contacts 610 are made every time the device 100 is inserted in device 600. In addition, the tapered end portion 114 of the aerosol-generating device 100 allows the user to more easily insert the device into the cavity 602.

FIG. 7(*a*) shows a primary device 700. The primary device 700 in this example is a charging and cleaning unit for an electrically heated smoking system. FIG. 7(*b*) shows a secondary device 702. The secondary device 702 in this example is an electrically heated aerosol-generating device adapted to receive a smoking article 704 comprising an aerosol-forming substrate. The primary device 700 comprises a primary battery 706, control electronics 708, and electrical contacts 710 configured to provide electrical power to the secondary device, from the battery 706, when the secondary device is in connection with the electrical contacts 710. The primary device is configured to charge the secondary device utilising the battery 706. The electrical contacts 710 are provided adjacent the bottom of a cavity 712. The cavity is configured to receive the secondary device 702. A lid 714 is provided that is configured to secure the secondary device 702 within the cavity 712 of the primary device 700. The components of the primary device 700 are housed within the housing 716. The lid 714 is coupled to the housing 716 by hinge 718. The operation of the lid is described in further detail below.

In addition, the primary device 700 is provided with a series of three indicators 720, 722 and 724. The indicator 720 is provided to indicate the level of charge remaining in the primary battery 706. The indicator 720 is configured to indicate the percentage of the charge remaining in the primary battery. For example, 100% would indicate that the battery 706 is fully charged, and 50% would indicate that the battery 706 is half charged.

The second indicator 722 is provided to indicate that the secondary device 702 is fully charged, and ready to be used to generate an aerosol. The indicator 722 only indicates this state of readiness once the secondary device is capable of providing sufficient power to provide the user with a complete smoking experience; for example, sufficient power to aerosolise the entire aerosol forming substrate 704, or sufficient power to generate a predetermined number of puffs. In this specific embodiment, the secondary device 702 cannot be operated unless the rechargeable battery 726 is fully charged.

The third indicator 724 is provided to indicate that the secondary device is being cleaned. The cleaning operation is described in further detail below.

The secondary device 702 comprises a rechargeable battery 726, secondary control electronics 728 and electrical contacts 730. As described above, the rechargeable battery 726 of the secondary device 702 is configured to receive a supply of power from the primary battery 706 when the electrical contacts 730 are in contact with the electrical contacts 710 of the primary device 700 and the lid is in the closed position. The secondary device 702 further comprises a cavity 732 configured to receive the aerosol generating article 704. A heater 734, in the form of, for example, a blade heater, is provided at the bottom of the cavity 732. In use, the user activates the secondary device 702, and power is provided from the battery 726 via the control electronics 728 to the heater 734. The heater is heated to a standard operational temperature that is sufficient to generate an aerosol from the aerosol-forming substrate of the aerosol-generating article 704. The components of the secondary device 702 are housed within the housing 736.

The primary device is provided with four electrical contacts 710, two to supply power to the secondary device, and two to communicate data between the primary device and the secondary device. The data connection is configured to download data from the secondary device such as usage statistics, operational status information and the like. In addition, the data connection is configured to upload data from the primary device to the secondary device such as operating protocols. The operating protocols may include power supply profiles to be used when supplying power from the secondary power supply to the heater. Data may be communicated from the secondary device 702 to the primary device 700 and stored in, for example, control electronics 708. Data may then be communicated out of primary device 700 via communication port 738 which may be connected to control electronics 708.

FIG. 8 shows the secondary device 702 housed within the cavity of the primary device 700. The lid 714 is shown in the closed position. In this closed position the lid is configured to act on the secondary device 702 such that a good electrical connection is made between the primary device and the secondary device. As can be seen, the electrical contacts 730 of the secondary device are engaged with the electrical contacts 710 of the primary device. The electrical contacts 710 of the primary device are configured such that they apply a force to the secondary device when the lid is in the closed position. The electrical contacts 710 form resilient elements and, absent any opposing force from the secondary device, are in a neutral position such that they are displaced from the bottom surface of the cavity 712; see FIG. 7(*a*).

The dimensions of the primary device are such that the lid will not close if a smoking article 704 is housed within the secondary device. Therefore, the secondary device cannot be charged or cleaned when it is housing a smoking article, as the lid cannot be moved to the closed position that would enable power to be supplied to the secondary device. This may prevent the user from using the secondary device to generate an aerosol when the secondary device is being charged or cleaned.

The lid 714 is provided with means for retaining the lid in the closed position. The retaining means provides sufficient force such that the lid acts on the secondary device to deflect the electrical contacts from the position shown in FIG. 7(*a*) to the engaged position shown in FIG. 8. The retaining means is a spring within the hinge 718. Alternatively, or in addition, the lid may be provided with ferrous elements adapted to engage with magnets provided in the housing of the primary device.

FIG. 9 shows a detail view of the electrical contact 710 of the primary unit. As can be seen, the electrical contact 710 is in the form of a leaf spring which enables the electrical contact 710 to be resilient in order to provide sufficient force to the secondary device, when the lid is in the closed position, to ensure a good electrical connection between the primary device and the secondary device. The electrical contact 710 is mounted to the primary device by support 900. The support 900 is configured such that the tail end 902 of the electrical contact remains substantially static as the secondary device is engaged with the electrical contact 710 at the contact end 904 and deflected from the neutral position shown in FIG. 7(*a*). The tail end 902 is connected to the control electronics by electrical wires, and thus by ensuring the tail end 902 remains substantially static during use reduces the possibility that the connection will fail due to fatigue. As described above, the primary device is provided with four such electrical contacts; two for electrical power, and two for data communication. The four electrical contacts are configured to provide a combined approximately 5N of force to the secondary device when the secondary device is in the cavity and the lid is in the closed position. The lid retaining means is therefore configured to provide approximately 7.5N of retaining force between the housing and the lid. The additional force is provided to reduce the possibility of the lid opening if the lid is accidentally knocked by the user during charging, or cleaning, of the secondary device.

Although a specific embodiment of the electrical contacts is provided herein, it will be obvious to the skilled person that any suitable configuration of electrical contacts may be used.

As described above, the primary device is also configured to perform a cleaning operation on the secondary device. The cleaning operation involves supplying sufficient electrical power to the secondary device to enable the heater 734 to be heated above its standard operational temperature to a cleaning temperature. The cleaning temperature is sufficient to liberate any remaining aerosol generating substrate that may remain affixed to the blade heater after the smoking article 704 has been removed from the secondary device 702. As shown in FIG. 10 the lid 714 comprises a vent hole 1000 which is configured to allow the liberated aerosol generating substrate to leave the cavity, for example in the form of an aerosol such as smoke. During the cleaning operation, the third indicator 724 is illuminated to inform the user that the secondary device is being cleaned. During this cleaning operation the user may be prevented from opening the lid to remove the secondary device.

FIG. 11(*a*) is a schematic illustration showing a coupling portion 1100 formed by one end of an aerosol-generating device, the coupling portion 1100 having an exemplary contact 1110 located at an end-face 1120. FIG. 11(*b*) shows a plan view of the end of the coupling portion 1100, illustrating the contact 1110, the end face 1120 and a tapered surface 1115.

The contact 1110 on the coupling portion 1100 is couplable to a contact 1130 located at a terminal face 1140 of a device receiving cavity 1150 of a charging device 1160. An internal wall 1170 of the device receiving cavity 1150 is tapered to approximate the tapered surface 1115 of the coupling portion 1100. As the aerosol-generating device is inserted into the cavity 1150, the tapered surfaces 1115, 1170 impinge and guide the aerosol-generating device contact 1110 and the charging device contact 1130 into alignment. It will now be apparent to one of ordinary skill in the art that the contact 1110 and contact 1130 may comprise one of the connectors 300, 608, 730 discussed in relation to FIGS. 3, 6 and 7 above and that such connectors and contacts may facilitate transfer of electrical charge or data between the aerosol-generating device and charging device discussed herein.

FIGS. 12(*a*) and 12(*b*) illustrate an alternative specific embodiment of an aerosol-generating system. A coupling portion 1200 of an aerosol-generating device has a substantially rectangular cross-section (FIG. 12(*b*) is a plan view of the end of the coupling portion and shows the cross-section). A strip-shaped contact 1210 is located on an end face 1220 of the coupling portion 1200. The coupling portion comprises a wedge-shaped taper 1212 having a tapered surface 1215. The tapered surface 1215 of the coupling portion 1200 engages with a tapered surface 1270 within a cavity 1250 of a charging unit 1260 such that the contact 1210 on the coupling portion can engage with a contact 1230 on the charging device to form a connection.

FIGS. 13(*a*) and 13(*b*) illustrate an alternative specific embodiment of an aerosol-generating system. A coupling portion 1300 of an aerosol-generating device has a substantially circular cross-section (FIG. 13(*b*) is a plan view of the end of the coupling portion and shows the cross-section). A contact 1310 is located on an end face 1320 of the coupling portion 1300. The coupling portion comprises a series of steps 1311, 1312. The stepped surface 1311, 1312 of the coupling portion 1300 engages with a stepped surface 1371, 1372 within a cavity 1350 of a charging unit 1360 such that the contact 1310 on the coupling portion can engage with a contact 1330 on the charging device to form a connection.

Figure 14A:
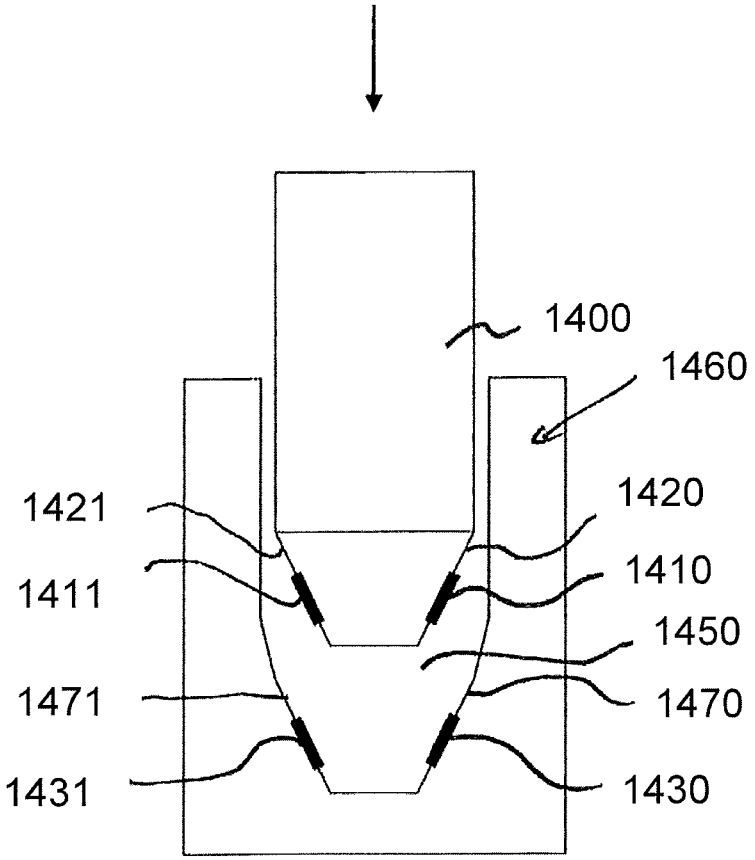
Figure 14B:
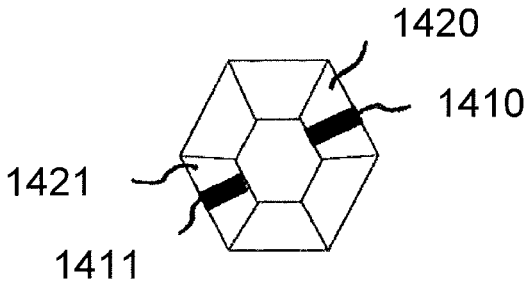

FIGS. 14A and 14B illustrate an alternative specific embodiment of an aerosol-generating system. A coupling portion 1400 of an aerosol-generating device has a substantially hexagonal cross-section (FIG. 14B is a plan view of the end of the coupling portion and shows the cross-section). Two contacts 1410, 1411 are located on tapered facets 1420, 1421 of the coupling portion 1400. The tapered facets 1420, 1421 of the coupling portion 1400 engage with tapered internal facets 1470, 1471 within a cavity 1450 of a charging unit 1460 such that the contacts 1410, 1411 on the coupling portion can engage with contacts 1430, 1431 on the charging device to form a connection.

Other details of the construction and use of these embodiments are the same as described above in relation to the embodiment of FIG. 1.

A preferred aerosol-generating device may be substantially cylindrical. FIGS. 15A to 15F illustrate various exemplary cross-sections that may impart an anti-rolling functionality for the device.

Figure 15:
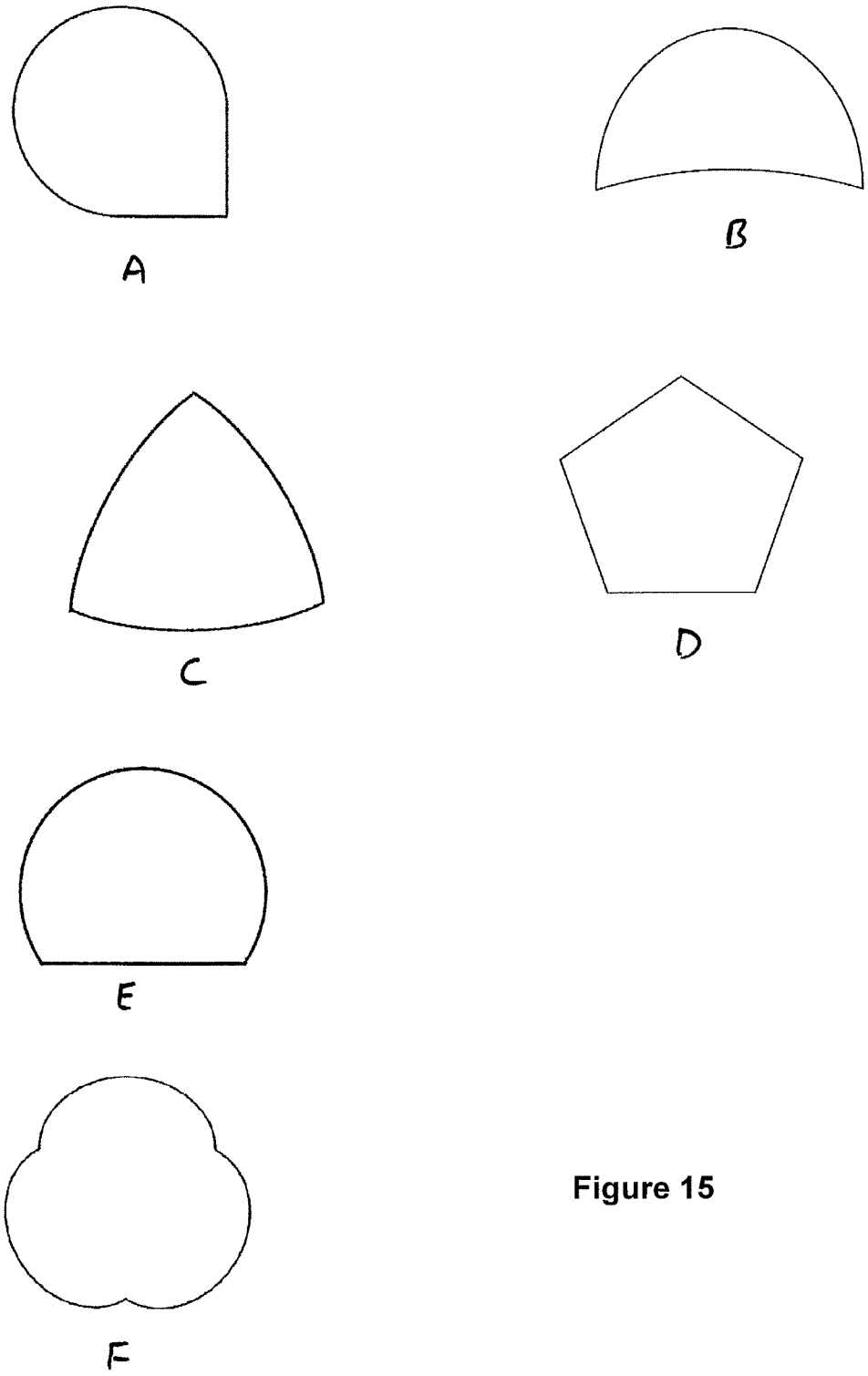

FIG. 15A, for example, is a tear-drop shape. If this shape forms the base of a cylinder, the cylinder will have an external surface that defines a single, longitudinal, line. While the device may be able to roll on its curved external portion, it cannot roll more for a complete revolution as the corner of the tear-drop will impinge on a surface.

FIG. 16 shows a projection of an embodiment of an aerosol-generating device 1600. The device comprises a first housing portion 1610 and a second housing portion 1620. Both housing portions are substantially elongate tubes having a decagonal transverse cross-section. When assembled, the first housing portion and the second housing portion meet at a join 1605. Join 1605 may alternatively be placed at other locations, such as locations indicated by lines 1607 or 1609, illustrated in FIG. 16. By providing join 1605 at locations 1607 or 1609, additional flexibility regarding the size of first and second housing portions 1610 and 1620 are provided.

A button 1630 extends through the housing. The button 1630 is connected to internal electronics and allows a user to actuate the device. Projections 1612, 1622 extend from each housing portion adjacent to the button. These projections accentuate the position of the button 1630, thereby allowing a user to actuate the device without looking to see the position of the button. These projections 1612, 1622 also serve a keying function when the device 1600 is coupled to a secondary unit. These projections 1612, 1622 also help shield the button and prevent accidental actuation of the device. These projections 1612, 1622 also contribute to the stability of the device by acting as barriers to the rolling of the device. As will now be apparent to one of ordinary skill in the art, the inclusion of projections 1612 and 1622 is optional as button 106 may provide equivalent functionality, as discussed in connection with FIGS. 1, 2, 3(*a*), 3(*b*) and 3(*c*) above.

A terminal end of the first housing portion 1610 is tapered 1611. A terminal end of the second housing portion 1620 is tapered 1621. The housing portions are formed from injection moulded polycarbonate (PC) having a wall thickness of approximately 0.75 mm. The injection mouldings were produced with injection points at an end of the mould and flow lines of the injected polymer extending along the longitudinal axis of each housing portion. The total length of the device is approximately 94 mm.

The outer cross-section of each housing portion is decagonal. The faces of the decagon 1700 are slightly curved so that the cross-section is a convex decagon. This is illustrated schematically in FIG. 17 where the dotted lines represent a perfect decagon, and the solid lines represent a convex decagon. It is noted that the curvature shown in FIG. 17 has been exaggerated considerably for illustrative purposes.

When the device 1600 is assembled and the first housing portion 1610 abuts the second housing portion 1620 at the join 1605, the slightly curved decagonal faces 1700 produce an optical effect that does not accentuate any mismatch or misalignment in the two housing portions.

The first housing portion 1610 defines a substrate receiving cavity as described above in relation to the embodiment of FIG. 1. This housing portion 1610 may be slideably separated from the second housing portion 1620 by sliding in a longitudinal direction. The first housing portion 1610 may be removed from the device 1600 entirely.

An inner surface 1800 of the first housing portion 1610 may have a decagonal cross-section or alternatively may be substantially cylindrical in shape. This inner surface 1800 engages with an internal body portion 1900 of the device that is substantially cylindrically shaped. The first housing portion 1610 is retained on the device 1600 by means of snaps 2000 (see regions outlined by circles in FIG. 18). The snaps 2000 comprise a combination of protrusions 2010 located on an inner surface of the housing portion with sprung protrusions 1910 or 1920 located on an outer surface of an inner body. The inner surface 1800 of the first housing portion 1610 has four pairs of longitudinally spaced protrusions 2010 that are circumferentially spaced within the inner surface 1800. These pairs of protrusions 2010 engage with sprung protrusions 1910, 1920 projecting from the inner body 1900. When the first portion of the housing 1610 abuts the second portion 1620, the pairs of protrusions 2010 engage with a first set of sprung protrusions 1910. The first housing portion 1610 is thereby retained against the second housing portion 1620.

By applying a force in a longitudinal direction, snaps 2000 are disengaged when the protrusions 2010 on the first housing portion 1610 disengage with the first set of sprung protrusions 1910 and the first housing portion 1610 may freely slide in a longitudinal axis. To retain the first housing portion 1610 in a second position, longitudinally spaced from the first position, the protrusions 2010 may engage with a second sprung protrusions 1920 located on the inner body 1900 and snaps 2000 are reengaged with the combination of protrusions 2010 and 1920. The second sprung protrusions 1920 are longitudinally spaced from the first sprung protrusions 1910. The sprung protrusions 1910, 1920 may be sprung by cantilever springs.

Other details of the construction and use of this embodiment are the same as described above in relation to the embodiment of FIG. 1.

It is of course to be understood that the specification is not intended to be restricted to the details of the above embodiments which are described by way of example only.

The invention claimed is:

1. An electrical system comprising a primary device and a secondary device, the primary device comprising:

a source of electrical power;

a cavity configured to receive the secondary device;

at least one electrical contact within the cavity configured to contact a corresponding electrical contact on the secondary device when the secondary device is in the cavity and to provide power to the secondary device, the at least one electrical contact being electrically connected to the source of electrical power;

at least one data contact within the cavity configured to contact a corresponding data contact on secondary device when the secondary device is in the cavity, configured to transfer data between the primary device and the secondary device, the at least one data contact being separate from the at least one electrical contact and configured not to provide power to the secondary device; and a lid moveable between a first position to retain the secondary device in contact with the at least one electrical contact and the at least one data contact and a second position in which the secondary device is free to move out of contact with the at least one electrical contact and the at least one data contact, wherein in the first position the lid urges the secondary device into contact with the at least one electrical contact and the at least one data contact, and wherein the secondary device is keyed to the cavity of the primary device.

2. The electrical system according to claim 1, wherein the secondary device being keyed to the cavity of the primary device comprises the cavity having a non-regular transverse cross-sectional shape, and the secondary device having a corresponding non-regular transverse cross-sectional shape.

3. The electrical system according to claim 2, wherein the non-regular transverse cross-sectional shape of the cavity comprises a protrusion configured to be keyed with the non-regular transverse cross-sectional shape of the secondary device having a slot.

4. The electrical system according to claim 2, wherein the non-regular transverse cross-sectional shape of the cavity comprises a slot configured to be keyed with the non-regular transverse cross-sectional shape of the secondary device having a protrusion.

5. The electrical system according to claim 1, wherein the secondary device comprises a coupling portion configured to couple the secondary device to the at least one electrical contact and the at least one data contact, and wherein the coupling portion is stepped or tapered.

6. The electrical system according to claim 5, wherein the tapered or stepped portion extends for between 5% and 20% of a length of the secondary device.

7. The electrical system according to claim 5, wherein the coupling portion has a transverse cross-section that is non-circular.

8. The electrical system according to claim 5, wherein the coupling portion has a transverse cross-section that is polygonal.

9. The electrical system according to claim 1, wherein the primary device is configured to prevent a supply of power to the secondary device through the at least one electrical contact when the lid is not in the first position.

10. The electrical system according to claim 1, wherein at least one of the at least one electrical contact and the at least one data contact comprises a resilient element configured to urge the secondary device towards the lid when the secondary device is positioned in the cavity.

11. The electrical system according to claim 1, wherein the lid comprises at least one aperture allowing an escape of material from the cavity when the secondary device is in the cavity and the lid is in the first position.

12. The electrical system according to claim 1, wherein the source of electrical power in the primary device comprises a rechargeable battery.

13. The electrical system according to claim 1, wherein the secondary device is an electrically heated aerosol generating device comprising a heating element and a rechargeable power source.

14. The electrical system according to claim 13, wherein the primary device is configured to provide power to the secondary device to recharge the rechargeable power source in the secondary device when the secondary device is in contact with the at least one electrical contact.

15. The electrical system according to claim 1, wherein the at least one electrical contact is mounted to the primary device by a support, which is configured such that a tail end of the at least one electrical contact remains static when the secondary device is engaged with the at least one electrical contact.

* * * * *